US008695985B2

(12) United States Patent
Potterfield et al.

(10) Patent No.: US 8,695,985 B2
(45) Date of Patent: Apr. 15, 2014

(54) STOWABLE SHOOTING TARGET ASSEMBLIES

(75) Inventors: Russell A. Potterfield, Columbia, MO (US); Tim Kinney, Columbia, MO (US); Adam Birk, Lohman, MO (US); Robert J. Zara, Rocheport, MO (US); Jim Gianladis, Columbia, MO (US)

(73) Assignee: Battenfeld Technologies, Inc., Columbia, MO (US)

( * ) Notice: Subject to any disclaimer, the term of this patent is extended or adjusted under 35 U.S.C. 154(b) by 296 days.

(21) Appl. No.: 12/986,959

(22) Filed: Jan. 7, 2011

(65) Prior Publication Data

US 2012/0175844 A1 Jul. 12, 2012

(51) Int. Cl.
*F41J 1/10* (2006.01)

(52) U.S. Cl.
USPC ..... 273/407; 40/610; 248/156

(58) Field of Classification Search
USPC ..... 273/403–410; 40/606.16, 606.19, 610; 248/156; 100/199
See application file for complete search history.

(56) References Cited

U.S. PATENT DOCUMENTS

| | | | |
|---|---|---|---|
| 197,397 | A | 11/1877 | O'Neill |
| 387,411 | A | 8/1888 | Gisel |
| 399,604 | A | 3/1889 | Dufner et al. |
| 499,315 | A | 6/1893 | Borchardt |
| 568,543 | A | 9/1896 | Parks |
| 668,219 | A | 2/1901 | Rock |
| 691,912 | A | 1/1902 | McClean |
| 718,865 | A | 1/1903 | Northcraft |
| 778,865 | A | 1/1905 | Hyenga |
| 789,909 | A | 5/1905 | Herold |
| 1,033,624 | A | 7/1912 | Schmeisser |
| 1,061,577 | A | 5/1913 | Whitney |
| 1,088,362 | A | 2/1914 | Perkins |
| 1,089,307 | A | 3/1914 | Benet et al. |
| 1,121,945 | A | 12/1914 | Smith |
| 1,145,585 | A | 7/1915 | Hebard |
| 1,175,692 | A | 3/1916 | Boicourt |
| 1,187,325 | A | 6/1916 | Ivey |
| 1,195,777 | A | 8/1916 | Burlin |
| 1,250,215 | A | 12/1917 | Panos |
| 1,256,255 | A | 2/1918 | Porter |
| 1,295,688 | A | 2/1919 | Butler |
| 1,367,353 | A | 2/1921 | Craig |
| 1,488,647 | A | 4/1924 | Quinn |
| 1,491,604 | A | 4/1924 | Fuller |

(Continued)

FOREIGN PATENT DOCUMENTS

| | | | |
|---|---|---|---|
| DE | 838872 | C | 5/1952 |
| EP | 0624455 | A2 | 11/1994 |
| GB | 475080 | A | 11/1937 |

OTHER PUBLICATIONS

U.S. Appl. No. 11/505,784, Cauley.

(Continued)

*Primary Examiner* — Mark Graham
(74) *Attorney, Agent, or Firm* — Senniger Powers LLP

(57) ABSTRACT

The present disclosure describes various embodiments of shooting target assemblies and associated systems and methods of use and manufacture. One aspect of the disclosure is directed to shooting target assemblies configurable in an assembled arrangement and a stowed arrangement. Another aspect of the disclosure is directed to shooting target assemblies having a stabilizer for improving target stability during operation.

25 Claims, 8 Drawing Sheets

(56) References Cited

U.S. PATENT DOCUMENTS 1,639,722 A 8/1927 Whitney
1,693,289 A 11/1928 Warren
1,736,244 A 11/1929 Baker
1,902,040 A 3/1933 Meyer
1,907,181 A 5/1933 Fey
1,927,876 A 9/1933 Meyer
1,928,871 A 10/1933 Swebilius
2,066,218 A 12/1936 Morgan
2,079,510 A 5/1937 King et al.
2,090,930 A 8/1937 Chubb
2,100,514 A 11/1937 Miller
2,121,982 A 6/1938 Pugsley
2,125,353 A 8/1938 Mattson
2,216,766 A 10/1940 Cook
2,232,743 A 2/1941 Swenson
2,297,993 A 10/1942 Tratsch
2,331,372 A 10/1943 Buchanan
2,372,111 A * 3/1945 Norberg ..... 273/407
2,378,545 A 6/1945 Fraser et al.
D147,305 S 8/1947 Sloan
2,432,519 A 12/1947 Garand
2,451,266 A 10/1948 Whittemore
2,455,644 A 12/1948 Barnes
2,476,078 A 7/1949 Banks
2,479,354 A 8/1949 Hanson
2,483,089 A 9/1949 Ferguson
2,484,801 A 10/1949 Anderson
2,508,951 A 5/1950 Kazimier
2,510,380 A 6/1950 Clifford
2,517,268 A 8/1950 Wilson
2,538,118 A * 1/1951 Miller ..... 273/407
2,638,676 A 5/1953 Callahan
2,677,207 A 5/1954 Stewart
2,701,930 A 2/1955 Dolan
2,731,829 A 1/1956 Wigington et al.
2,740,530 A 4/1956 Ponder
2,753,642 A 7/1956 Sullivan
2,774,090 A 12/1956 Allinson
2,774,563 A 12/1956 Pribis
2,795,881 A 6/1957 Bellows
2,813,376 A 11/1957 Middlemark
2,817,233 A 12/1957 Dower et al.
2,821,117 A 1/1958 Hultgren
2,847,909 A 8/1958 Kester
2,867,931 A 1/1959 Schreiber
2,877,689 A 3/1959 Pribis
2,894,347 A 7/1959 Woodcock
2,924,881 A 2/1960 Gee
2,924,904 A 2/1960 Amsler
2,924,914 A 2/1960 Garwood
2,975,540 A 3/1961 Lewis
2,999,788 A 9/1961 Morgan
3,011,283 A 12/1961 Lunn et al.
3,012,350 A 12/1961 Wold
3,023,527 A 3/1962 Leek et al.
3,024,653 A 3/1962 Broadway
3,036,705 A * 5/1962 Haecker ..... 206/579
3,041,938 A 7/1962 Seabrook
3,055,655 A 9/1962 Chelf
3,060,612 A 10/1962 Brown et al.
3,080,166 A * 3/1963 Clark ..... 273/407
3,087,701 A * 4/1963 Wallace ..... 248/166
3,112,567 A 12/1963 Flanagan
3,125,929 A 3/1964 Peasley
3,128,668 A 4/1964 Dicken
3,137,957 A 6/1964 Ingalls
3,163,420 A 12/1964 Braun
3,175,456 A 3/1965 Goodsell
3,183,617 A 5/1965 Ruger et al.
3,200,786 A * 8/1965 Swezy et al. ..... 116/63 P
3,205,518 A 9/1965 Romaine
3,206,885 A 9/1965 Dye
3,225,656 A 12/1965 Flaherty et al.
D203,680 S 2/1966 Allison
3,240,103 A 3/1966 Lamont
3,259,986 A 7/1966 Carr
3,283,425 A 11/1966 Boyd
3,283,643 A 11/1966 Mittelsteadt
3,291,317 A 12/1966 Bowen
3,292,293 A 12/1966 Chiasera et al.
3,320,848 A 5/1967 Ponsness
3,323,246 A 6/1967 Loffler
3,327,422 A 6/1967 Harris
3,330,561 A 7/1967 Kandel
3,343,411 A 9/1967 Lee
3,353,827 A 11/1967 Dun, Jr.
3,370,852 A 2/1968 Kandel
3,406,969 A 10/1968 Tisdell et al.
3,423,092 A 1/1969 Kandel
D215,311 S 9/1969 Born
3,486,752 A 12/1969 Colvin
3,499,525 A 3/1970 Kanter
3,510,951 A 5/1970 Dow
3,513,604 A 5/1970 Matsunaga et al.
3,519,272 A * 7/1970 De Vogelaere ..... 273/404
3,536,160 A 10/1970 Brewer
3,540,729 A * 11/1970 Rahberger ..... 273/407
3,550,941 A 12/1970 Spiro et al.
3,556,666 A 1/1971 Lichenstem
D220,154 S 3/1971 Irelan
3,572,712 A 3/1971 Vick
3,580,127 A 5/1971 Lee
3,583,556 A 6/1971 Wagner
3,584,820 A 6/1971 Butcher, Sr.
3,587,193 A 6/1971 Lewis
3,608,225 A 9/1971 Manuel
3,680,266 A 8/1972 Shiplov
3,680,354 A 8/1972 Phillips, Jr.
3,711,955 A 1/1973 Holt
3,711,984 A 1/1973 Dyer et al.
3,739,515 A 6/1973 Koon, Jr.
3,743,088 A 7/1973 Henkin
3,744,292 A 7/1973 Michelson
3,745,875 A 7/1973 Kennedy et al.
3,748,950 A 7/1973 Huntington
3,764,219 A 10/1973 Collins
3,769,758 A 11/1973 McDonald
3,804,238 A 4/1974 Howard
3,813,816 A 6/1974 Funk
3,815,270 A 6/1974 Pachmayr
3,826,559 A 7/1974 Berliner et al.
3,827,172 A 8/1974 Howe
3,842,527 A 10/1974 Low
D233,853 S 12/1974 Ferrara
3,877,178 A 4/1975 Campanelli
3,878,939 A 4/1975 Wilcox
3,885,357 A 5/1975 Hoyt
3,893,266 A 7/1975 Anderson et al.
3,895,803 A 7/1975 Loe
3,899,175 A 8/1975 Loe
D237,106 S 10/1975 Baljet et al.
3,913,746 A 10/1975 Burton
3,914,879 A 10/1975 Taylor, III et al.
3,935,657 A 2/1976 Wade
3,947,988 A 4/1976 Besaw
3,949,987 A 4/1976 Candor
3,961,436 A 6/1976 Hagen et al.
3,964,613 A 6/1976 Anderson, Jr.
3,979,849 A 9/1976 Haskins
4,007,554 A 2/1977 Helmstadter
4,012,860 A 3/1977 Auger
4,021,971 A 5/1977 McFadden
4,026,057 A 5/1977 Cady
4,027,781 A 6/1977 Covert
4,029,318 A * 6/1977 Boss ..... 273/390
4,042,242 A 8/1977 Nicholls et al.
4,054,288 A 10/1977 Perrine, Sr.
4,055,016 A 10/1977 Katsenes
4,072,313 A 2/1978 Murso et al.
4,076,247 A 2/1978 Kim et al.
4,090,606 A 5/1978 Dawson
4,120,108 A 10/1978 Vickers et al.
4,120,276 A 10/1978 Curran
4,122,623 A 10/1978 Stice

(56) References Cited

U.S. PATENT DOCUMENTS 4,143,491 A 3/1979 Blanc
4,177,608 A 12/1979 Balz
4,188,855 A 2/1980 Alberts
4,203,600 A 5/1980 Brown
4,206,573 A 6/1980 Hayward
4,222,305 A 9/1980 Lee
4,223,588 A 9/1980 Simpson
4,233,748 A 11/1980 Ford et al.
D257,687 S 12/1980 Bechtel
4,266,748 A 5/1981 Dalton
4,266,780 A 5/1981 McQuary
4,282,671 A 8/1981 Wood et al.
D260,650 S 9/1981 Alviti
D261,794 S 11/1981 Bechtel
4,301,625 A 11/1981 Rampe
4,312,146 A 1/1982 Koon, Jr.
4,332,185 A 6/1982 Hargrove
4,333,385 A 6/1982 Culver
4,338,726 A 7/1982 Swailes
4,340,370 A 7/1982 Marshall et al.
4,345,398 A 8/1982 Pickett
4,346,530 A 8/1982 Stewart et al.
4,359,833 A 11/1982 Pachmayr et al.
4,361,989 A 12/1982 Ohno
4,368,586 A * 1/1983 Forzelias ..... 40/604
4,385,464 A 5/1983 Casull
4,385,545 A 5/1983 Duer
4,391,058 A 7/1983 Casull
4,392,321 A 7/1983 Bosworth
4,407,379 A 10/1983 Pryor et al.
4,409,751 A 10/1983 Goda et al.
4,542,677 A 9/1985 Lee
4,548,392 A 10/1985 Rickling
4,558,531 A 12/1985 Kilby
D283,561 S 4/1986 Geist
4,601,124 A 7/1986 Brown, Jr.
4,608,762 A 9/1986 Varner
4,621,563 A 11/1986 Poiencot
4,625,620 A 12/1986 Harris
4,632,008 A 12/1986 Horner
4,644,987 A 2/1987 Kiang et al.
4,648,191 A 3/1987 Goff et al.
4,653,210 A 3/1987 Poff, Jr.
4,671,364 A 6/1987 Fink et al.
4,674,216 A 6/1987 Ruger et al.
4,695,060 A 9/1987 Pilgrim
4,696,356 A 9/1987 Ellion et al.
4,702,029 A 10/1987 DeVaul et al.
4,716,673 A 1/1988 Williams et al.
4,721,205 A 1/1988 Burt et al.
4,723,472 A 2/1988 Lee
4,729,186 A 3/1988 Rieger et al.
4,732,394 A 3/1988 Stein et al.
4,751,963 A 6/1988 Bui et al.
D297,855 S 9/1988 Ruger et al.
4,776,471 A 10/1988 Elkins
4,790,079 A 12/1988 Meyers
4,790,096 A 12/1988 Gibson et al.
4,799,324 A 1/1989 Nodo
4,807,381 A 2/1989 Southard
4,807,888 A 2/1989 Pidde et al.
4,811,956 A * 3/1989 Foreman ..... 273/407
4,815,593 A 3/1989 Brown
4,819,359 A 4/1989 Bassett
4,821,422 A 4/1989 Porter
4,821,443 A 4/1989 Bianco
4,823,673 A 4/1989 Downing
4,824,086 A 4/1989 Rickling et al.
4,841,839 A 6/1989 Stuart
4,850,151 A 7/1989 Ditscherlein
4,854,066 A 8/1989 Canterbury, Sr.
4,862,567 A 9/1989 Beebe
D304,223 S 10/1989 Ruger et al.
4,873,777 A 10/1989 Southard
4,890,406 A 1/1990 French
4,890,847 A 1/1990 Cartee et al.
4,896,446 A 1/1990 Gregory
D306,234 S 2/1990 Ferstl
4,903,425 A 2/1990 Harris
4,910,904 A 3/1990 Rose
4,918,825 A 4/1990 Lesh et al.
4,921,256 A 5/1990 Gearhart
4,923,402 A 5/1990 Marshall et al.
4,924,616 A 5/1990 Bell
4,937,965 A 7/1990 Narvaez
D310,302 S 9/1990 Southard
4,967,497 A 11/1990 Yakscoe
4,971,208 A 11/1990 Reinfried, Jr. et al.
4,972,619 A 11/1990 Eckert
4,979,752 A 12/1990 Fosseen
D313,886 S 1/1991 Southard
4,987,694 A 1/1991 Lombardo
4,998,367 A 3/1991 Leibowitz
4,998,944 A 3/1991 Lund
5,005,657 A 4/1991 Ellion et al.
5,009,021 A 4/1991 Nelson
5,014,793 A 5/1991 Germanton et al.
5,031,348 A 7/1991 Carey
5,050,330 A 9/1991 Pilgrim et al.
5,058,302 A 10/1991 Minneman
5,060,410 A 10/1991 Mueller
5,063,679 A 11/1991 Schwandt
5,067,268 A 11/1991 Ransom
5,067,683 A * 11/1991 Wager ..... 248/545
5,070,636 A 12/1991 Mueller
5,074,188 A 12/1991 Harris
5,081,783 A 1/1992 Jarvis
5,117,850 A 6/1992 Money
5,123,194 A 6/1992 Mason
5,125,389 A 6/1992 Paff
5,149,900 A 9/1992 Buck
5,169,157 A * 12/1992 Salmon ..... 273/407
5,173,563 A 12/1992 Gray
5,180,874 A 1/1993 Troncoso, Jr.
5,185,927 A 2/1993 Rivers
5,186,468 A 2/1993 Davies
5,188,371 A 2/1993 Edwards
5,194,678 A 3/1993 Kramer
D335,896 S 5/1993 Evenson
5,211,404 A 5/1993 Grant
5,221,806 A 6/1993 Chaney et al.
5,222,306 A 6/1993 Neumann
5,228,887 A 7/1993 Mayer et al.
5,232,227 A 8/1993 Bateman
5,233,779 A 8/1993 Shaw
5,235,764 A 8/1993 Perazzi et al.
5,237,778 A 8/1993 Baer
5,240,258 A 8/1993 Bateman
5,247,758 A 9/1993 Mason
5,271,175 A 12/1993 West, III
5,275,890 A 1/1994 Wolf et al.
5,287,643 A 2/1994 Arizpe-Gilmore
5,311,693 A 5/1994 Underwood
5,315,781 A 5/1994 Beisner
5,316,579 A 5/1994 McMillan et al.
5,317,826 A 6/1994 Underwood
5,320,217 A 6/1994 Lenarz
5,320,223 A 6/1994 Allen
5,328,029 A 7/1994 Chow et al.
5,332,185 A 7/1994 Walker, III
5,333,829 A 8/1994 Bell et al.
5,335,578 A 8/1994 Lorden et al.
5,344,012 A 9/1994 Matthews
5,347,740 A 9/1994 Rather et al.
5,351,428 A 10/1994 Graham
5,358,254 A 10/1994 Yeh et al.
5,361,505 A 11/1994 Faughn
5,367,232 A 11/1994 Netherton et al.
5,370,240 A 12/1994 Hand
5,375,337 A 12/1994 Butler
5,375,377 A 12/1994 Kenton
5,377,437 A 1/1995 Underwood
5,392,553 A 2/1995 Carey
5,394,983 A 3/1995 Latulippe et al.

(56) References Cited

U.S. PATENT DOCUMENTS 5,402,595 A 4/1995 Tamllos
5,406,733 A 4/1995 Tarlton et al.
5,410,833 A 5/1995 Paterson
5,414,949 A 5/1995 Peebles
D359,392 S 6/1995 Bellington
5,421,115 A 6/1995 McKay
5,433,010 A 7/1995 Bell
5,433,451 A 7/1995 De Vries
5,435,223 A 7/1995 Blodgett et al.
5,442,860 A 8/1995 Palmer
D362,116 S 9/1995 Bellington et al.
5,446,987 A 9/1995 Lee et al.
D364,080 S 11/1995 Weyrauch
5,481,817 A 1/1996 Parker
5,482,241 A 1/1996 Oglesby
5,486,135 A 1/1996 Arpaio
5,490,302 A 2/1996 Dion
5,491,921 A 2/1996 Allen
5,497,557 A 3/1996 Martinsson
5,497,575 A 3/1996 Fried
5,501,467 A 3/1996 Kandel
5,503,356 A * 4/1996 Shelby ..... 248/170
D369,904 S 5/1996 Taylor
5,545,855 A 8/1996 Stanfield et al.
5,562,208 A 10/1996 Hasler et al.
D375,538 S 11/1996 Minneman
5,570,513 A 11/1996 Peterson
5,579,599 A * 12/1996 Haeseler ..... 40/606.19
5,580,063 A 12/1996 Edwards
5,588,242 A 12/1996 Hughes
5,598,996 A * 2/1997 Rath ..... 248/163.1
5,600,913 A 2/1997 Minneman
5,617,666 A 4/1997 Scott
5,622,344 A 4/1997 Gracie
5,628,135 A 5/1997 Cady
5,640,944 A 6/1997 Minneman
5,644,862 A 7/1997 Folmer
5,649,465 A 7/1997 Beebe
5,651,207 A 7/1997 Knight
5,653,625 A 8/1997 Pierce et al.
5,661,919 A 9/1997 Pryor
5,662,516 A 9/1997 You
5,666,757 A 9/1997 Helmstadter
D387,123 S 12/1997 Hughes et al.
5,703,317 A 12/1997 Levilly et al.
5,711,102 A 1/1998 Plaster et al.
5,711,103 A 1/1998 Keng
5,715,625 A 2/1998 West, III
D391,616 S 3/1998 Plybon
5,723,183 A 3/1998 Williams et al.
5,723,806 A 3/1998 Odom
5,737,865 A 4/1998 Brandl et al.
5,740,625 A 4/1998 Jenkins
5,758,447 A 6/1998 Venetz
5,758,933 A 6/1998 Clendening
5,761,954 A 6/1998 Dvorak
5,778,589 A 7/1998 Teague
5,779,527 A 7/1998 Maebashi
5,811,720 A 9/1998 Quinnell et al.
5,813,131 A 9/1998 Werre
5,815,974 A 10/1998 Keng
5,829,753 A * 11/1998 Wiser ..... 273/407
5,833,308 A 11/1998 Strong, III et al.
D403,176 S 12/1998 Harper
5,857,279 A 1/1999 de Oliveira Masina et al.
5,875,580 A 3/1999 Hill et al.
5,878,504 A 3/1999 Harms
5,884,966 A 3/1999 Hill et al.
5,899,329 A 5/1999 Hu et al.
5,907,919 A 6/1999 Keeney
5,913,667 A 6/1999 Smilee
5,913,668 A 6/1999 Messer
5,924,694 A 7/1999 Kent
5,930,932 A 8/1999 Peterson
5,933,997 A 8/1999 Barrett
5,933,999 A 8/1999 McClure et al.
5,947,477 A * 9/1999 Turnipseed ..... 273/407
5,959,613 A 9/1999 Rosenberg et al.
5,967,523 A * 10/1999 Brownlee ..... 273/407
5,970,642 A 10/1999 Martin
5,974,719 A 11/1999 Simonek
6,019,375 A 2/2000 West, Jr.
6,021,891 A 2/2000 Anderson
6,042,080 A 3/2000 Shepherd et al.
6,044,747 A 4/2000 Felts
D424,652 S * 5/2000 Minneman ..... D22/113
6,058,641 A 5/2000 Vecqueray
6,073,381 A 6/2000 Farrar et al.
6,086,375 A 7/2000 Legros
6,092,662 A 7/2000 Frederick, Jr.
6,110,020 A 8/2000 Rolfi
6,121,556 A 9/2000 Cole
6,237,462 B1 5/2001 Hawkes et al.
6,254,100 B1 7/2001 Rinehart
6,260,463 B1 7/2001 Brand et al.
6,269,578 B1 8/2001 Callegari
6,283,428 B1 9/2001 Maples et al.
6,289,622 B1 9/2001 Desch, Jr. et al.
6,293,041 B2 9/2001 Weaver
6,294,759 B1 9/2001 Dunn, Jr.
6,305,117 B1 10/2001 Hales, Sr.
6,309,476 B1 10/2001 Ravenscroft et al.
6,338,218 B1 1/2002 Hegler
6,390,294 B1 5/2002 Fiore, Jr. et al.
6,397,720 B1 6/2002 Fox et al.
6,435,512 B1 * 8/2002 Beckwith, Sr. ..... 273/407
6,439,515 B1 8/2002 Powers
6,439,530 B1 8/2002 Schoenfish et al.
6,517,133 B2 2/2003 Seegmiller et al.
D471,248 S 3/2003 Jacobs
6,526,687 B1 3/2003 Looney
D473,376 S 4/2003 Abate
6,546,662 B1 4/2003 Chong
6,557,855 B2 5/2003 Wu
6,574,899 B1 6/2003 Mostello
6,575,469 B2 6/2003 Love
6,643,973 B1 11/2003 Smith
6,663,298 B2 12/2003 Haney
6,688,031 B2 2/2004 Steele
6,733,375 B2 5/2004 Hoffman
6,736,400 B1 5/2004 Cesternino
6,813,855 B2 11/2004 Pinkley
6,814,654 B2 11/2004 Rolfi
6,854,975 B2 2/2005 Ranzinger
6,860,054 B1 3/2005 Mosher
6,862,833 B1 3/2005 Gurtner
6,871,440 B2 3/2005 Highfill et al.
6,877,266 B1 4/2005 Brownlee
6,883,263 B1 4/2005 Carrow
6,931,777 B1 8/2005 Krien
6,953,114 B2 10/2005 Wang et al.
D513,055 S 12/2005 Lahti
6,978,569 B2 12/2005 Williamson, IV et al.
D519,183 S 4/2006 Minneman
7,032,494 B2 4/2006 Wygant
D521,100 S 5/2006 Morrow
7,062,979 B2 6/2006 Day et al.
D524,541 S 7/2006 Cauley
7,086,192 B2 8/2006 Deros
7,104,398 B1 9/2006 Wisecarver
7,134,663 B1 11/2006 Lowe et al.
7,143,986 B1 12/2006 Austin et al.
7,152,355 B2 12/2006 Fitzpatrick et al.
7,152,358 B1 12/2006 LeAnna et al.
7,159,711 B1 1/2007 Gardner
7,165,750 B2 1/2007 McCuskey et al.
7,188,445 B2 3/2007 Lehman
D540,904 S 4/2007 Werner
7,201,376 B2 4/2007 Kuosa
7,207,567 B1 4/2007 Brown
7,225,050 B2 5/2007 Sutula, Jr.
D553,219 S 10/2007 Potterfield
7,281,346 B1 10/2007 Cook et al.
7,338,048 B1 * 3/2008 Hulstine et al. ..... 273/407

(56) References Cited

U.S. PATENT DOCUMENTS

| | | | | |
|---|---|---|---|---|
| D567,895 | S | 4/2008 | Cauley | |
| 7,356,960 | B1 | 4/2008 | Knitt | |
| 7,356,961 | B2 | 4/2008 | Williams | |
| 7,357,250 | B2 | 4/2008 | Hagemann et al. | |
| 7,363,740 | B2 | 4/2008 | Kincel | |
| 7,367,451 | B2 | 5/2008 | Pendergraph et al. | |
| 7,374,173 | B2 * | 5/2008 | Nasuti | 273/407 |
| 7,401,431 | B2 | 7/2008 | Pierce et al. | |
| D576,245 | S | 9/2008 | Potterfield et al. | |
| 7,421,815 | B1 | 9/2008 | Moody et al. | |
| 7,426,800 | B2 | 9/2008 | Pierce et al. | |
| 7,434,810 | B2 * | 10/2008 | DeMille et al. | 273/404 |
| 7,536,820 | B2 | 5/2009 | Wade et al. | |
| 7,546,992 | B1 * | 6/2009 | Cappolina | 248/166 |
| 7,549,247 | B1 | 6/2009 | Reese | |
| 7,584,690 | B2 | 9/2009 | Cauley | |
| D605,246 | S | 12/2009 | Hobbs | |
| 7,631,455 | B2 | 12/2009 | Keng et al. | |
| 7,654,498 | B1 | 2/2010 | Beltz | |
| 7,676,977 | B1 | 3/2010 | Cahill et al. | |
| 7,681,886 | B2 | 3/2010 | Morrow et al. | |
| 7,694,973 | B1 | 4/2010 | Hofmeister et al. | |
| 7,726,478 | B2 | 6/2010 | Potterfield et al. | |
| 7,730,824 | B1 | 6/2010 | Black | |
| 7,832,569 | B1 * | 11/2010 | Nemenz | 211/85.3 |
| 8,162,320 | B2 * | 4/2012 | Medina et al. | 273/407 |
| 2002/0113372 | A1 | 8/2002 | Love | |
| 2003/0079395 | A1 | 5/2003 | Chong | |
| 2004/0020097 | A1 | 2/2004 | Deros | |
| 2004/0112777 | A1 | 6/2004 | Huang | |
| 2004/0134113 | A1 | 7/2004 | Deros et al. | |
| 2005/0000141 | A1 | 1/2005 | Cauley et al. | |
| 2005/0011101 | A1 | 1/2005 | Gooder | |
| 2005/0115137 | A1 | 6/2005 | Minneman | |
| 2005/0178039 | A1 | 8/2005 | Flores | |
| 2005/0183319 | A1 | 8/2005 | Franks | |
| 2005/0188597 | A1 | 9/2005 | Keng et al. | |
| 2005/0242250 | A1 | 11/2005 | Keng et al. | |
| 2006/0174532 | A1 | 8/2006 | Popikow | |
| 2006/0175213 | A1 | 8/2006 | Hurt et al. | |
| 2006/0218840 | A1 | 10/2006 | Cauley | |
| 2006/0220318 | A1 * | 10/2006 | Law | 273/407 |
| 2006/0236584 | A1 | 10/2006 | Williams | |
| 2006/0248774 | A1 | 11/2006 | Pierce et al. | |
| 2006/0248775 | A1 | 11/2006 | Wade et al. | |
| 2006/0249908 | A1 * | 11/2006 | Angles | 273/404 |
| 2006/0254111 | A1 | 11/2006 | Giauque et al. | |
| 2006/0277811 | A1 | 12/2006 | Peterson | |
| 2006/0278797 | A1 | 12/2006 | Keng et al. | |
| 2007/0029733 | A1 | 2/2007 | Anderson | |
| 2007/0046760 | A1 | 3/2007 | Zara | |
| 2007/0051028 | A1 | 3/2007 | Stordal | |
| 2007/0068379 | A1 | 3/2007 | Sween et al. | |
| 2007/0074439 | A2 | 4/2007 | Cauley et al. | |
| 2007/0074440 | A2 | 4/2007 | Cauley | |
| 2007/0094911 | A1 | 5/2007 | Rush et al. | |
| 2007/0113460 | A1 | 5/2007 | Potterfield et al. | |
| 2007/0175077 | A1 | 8/2007 | Laney et al. | |
| 2007/0256346 | A1 | 11/2007 | Potterfield et al. | |
| 2007/0262529 | A1 | 11/2007 | Gamez et al. | |
| 2007/0266610 | A1 | 11/2007 | Coffield | |
| 2007/0294929 | A1 | 12/2007 | Potterfield et al. | |
| 2007/0295197 | A1 | 12/2007 | Potterfield | |
| 2008/0023379 | A1 | 1/2008 | Potterfield et al. | |
| 2008/0034636 | A1 | 2/2008 | Potterfield et al. | |
| 2008/0041700 | A1 | 2/2008 | Potterfield et al. | |
| 2008/0047189 | A1 | 2/2008 | Potterfield et al. | |
| 2008/0054570 | A1 | 3/2008 | Potterfield et al. | |
| 2008/0061509 | A1 | 3/2008 | Potterfield | |
| 2008/0127815 | A1 | 6/2008 | Yale et al. | |
| 2008/0128002 | A1 | 6/2008 | Jeffs | |
| 2008/0156671 | A1 | 7/2008 | Jansson | |
| 2008/0163534 | A1 | 7/2008 | Lombardi | |
| 2008/0168697 | A1 | 7/2008 | Potterfield et al. | |
| 2008/0174071 | A1 | 7/2008 | Potterfield et al. | |
| 2008/0295379 | A1 | 12/2008 | Potterfield et al. | |
| 2009/0020447 | A1 | 1/2009 | Potterfield et al. | |
| 2009/0049731 | A1 | 2/2009 | Seuk | |
| 2009/0056192 | A1 | 3/2009 | Oz | |
| 2009/0064559 | A1 | 3/2009 | Potterfield et al. | |
| 2009/0079136 | A1 * | 3/2009 | Shalosky | 273/407 |
| 2009/0126250 | A1 | 5/2009 | Keng | |
| 2010/0032905 | A1 | 2/2010 | Morrow et al. | |
| 2010/0116163 | A1 | 5/2010 | Zara | |
| 2010/0126055 | A1 | 5/2010 | Potterfield | |
| 2010/0138032 | A1 | 6/2010 | Potterfield | |
| 2010/0225062 | A1 * | 9/2010 | Shum | 273/359 |
| 2010/0236125 | A1 | 9/2010 | Morrow et al. | |
| 2010/0270201 | A1 | 10/2010 | Cauley et al. | |
| 2011/0024985 | A1 | 2/2011 | Potterfield | |
| 2011/0036214 | A1 | 2/2011 | Potterfield | |
| 2011/0036236 | A1 | 2/2011 | Potterfield et al. | |
| 2011/0154703 | A1 * | 6/2011 | Petrovic | 40/606.13 |

OTHER PUBLICATIONS

U.S. Appl. No. 11/739,077, Cauley et al.
U.S. Appl. No. 11/862,821, Cesternino.
U.S. Appl. No. 11/937,466, Potterfield et al.
U.S. Appl. No. 12/037,336, Potterfield.
U.S. Appl. No. 12/117,668, Potterfield et al.
U.S. Appl. No. 12/172,848, Cesternino et al.
U.S. Appl. No. 12/177,032, Potterfield et al.
U.S. Appl. No. 12/276,229, Cauley et al.
U.S. Appl. No. 12/476,041, Cauley.
U.S. Appl. No. 12/769,438.

"American Rifleman: What to do about recoil," LookSmart, http://www.findarticles.com/p/articles/mi_qa3623/is_199907/ai_n8861959/print, pp. 1-4 [Internet accessed on Jan. 4, 2006].

"Cabela's Rotary Media Separator," http://www.cabelas/en/templates/links/link.jsp;jsessionid=QYVQMKM0P0P5.., 2 pages [Internet accessed Apr. 24, 2007].

"Cleaning Cradles: Sinclaire Cleaning Cradles" p. 21, The date on which the Sinclair Folding Cleaning Cradle was first on sale is not known, but is believed to be circa 2004.

"Decker Rifle Vise," 1 page. The date on which the Decker Rifle Vise was first on sale is not known but is believed to be circa 2004.

"Eforcity Magnetic Screwdriver Set w/15 bits Great for Cellphones, Computers Includes: T6, Torx, Security Torx, Philips, Slotted, Spanner, Tri-Wing, Bent Pry Tool, Round Awl, Reset Pin for Game Boy Advance, Nintendo Wii, DS lite, NDS, Apple TV" , Amazon.com , accessed on Sep. 18, 2007.

"Gun Rest—Shooting Rest—Rifle Rests," http://www.jexploreproducts.com/gunrests-shootingrests.htm, 6 pages [Internet accessed Jul. 18, 2008].

"Plano Shooters Case, Brown Camo," The Sportsman's Guide, http://www.sportmansguide.com/cb/cb.asp?a=148225, the date on which the Plano Shooters Case was first on sale is not known but is believed to be circa 2004, 3 pages [Internet accessed no Oct. 11, 2006].

"Reloading Manual Number Ten for Rifle and Pistol," The Cartridge Components, SPEER Omark Industries, pp. 28-54.

"Shotshell reloading with a Grabber," MEC—Mayville Engineering Company, Inc., pp. 1-12.

"The Grabber and Hustler '76," MEC—Mayville Engineering Company, Inc., 2 pgs, date unknown.

"Uncle Bud's Bull Bags," http:www.unclebudscss.com/pages/Bulls%20bags.html, 2 pgs. [Internet accessed on Feb. 14, 2006].

"Uncle Bud's Udder Bag," http:www.unclebudscss.com/pages/Udder%20Bags.html, 2 pgs. [Internet accessed on Feb. 14, 2006].

1shop2.com "Hoppe's Gunsmith's Fully Adjustable Bench Vise" 3 pages. The date on which The Hoppe's Gunsmith's Fully Adjustable Bench Vise was first on sale is not known, but is believed to be circa 2004.

AcuSport, Outdoor Sporting Products, 3 pgs., undated.

Amazon.com, "CTK® P3 Ultimate Shooting Rest," Sports & Outdoors, http://www.amazon.com/CTK%C2%AE-P3-Ultimate-Shooting-Rest/dp/. . . , 1 page [Internet accessed on Jul. 22, 2008].

Amazon.com, "SHTRS RDG Steady PNT Rifle Rest DLX, Grips/Pads/Stocks, Gun Accessories, Hunting & Shooting Accessories,

(56) References Cited

OTHER PUBLICATIONS

Hunting Gear, Fishing & Hunting," http://www.amazon.com/STEADY-Accessories-Hunting-Shooting-Fishin . . . , 1 page [Internet accessed on Jul. 22, 2008].
Amazon.com, "Stoney Point Adjustable Shooting Rest w/Bag," Sports & Outdoors, http://www.amazon.com/Stoney-Point-Adjustable-Shooting-Rest/dp/B0.., 1 page [Internet accessed on Jul. 22, 2008].
Auto-Flo Lyman Turbo 1200 Tumbler, 2 pages [product photos].
Basspro.com, "Bass Pro Shops Outdoors Online: Offering the best in Fishing, Hunting and Outdoor Products," http://www.basspro.com/webapp/wcs/stores/servlet/Product_10151_-1_10001_95064_SearchResults, 2 pages [Internet accessed on Aug. 6, 2008].
Battenfeld Technologies, Inc., "Gun Vise," Tipton Gun Cleaning Supplies, Battenfeld Technologies, Inc. 2004 Catalog, p. 32, Product No. 782-731, 2 pgs.
Battenfeld Technologies, Inc., "Steady Rest Portable Shooting Rest," 1 page [Internet accessed Jan. 25, 2006].
Big Boy Gun Toys, "Shooting Rest," http://www.bigboyguntoys.com/shootingrest.htm, 1 page [Internet accessed on Jul. 18, 2008].
Birchwood Casey 2005 Catalog, 28 pages.
Birchwood Casey 2006 Catalog. The date of availability of this catalog is unknown, but is believed to be in Jan. 2006 or later. pp. 5-17.
Birchwood Casey, "Dirty Bird@Splattering Targets," http://www.birchwoodcasey.com/sport/target_index.asp?categoryID=4&subcat=22 , pp. 1-4, Internet accessed Jan. 16, 2006.
Birchwood Casey, "Shoot•N•C® Targets," http://www.birchwoodcasey.com/sport/target_index.asp?categoryID=4&subcat=8, pp. 1-8, internet accessed Jan. 16, 2006.
Birchwood Casey, "Targets Spots®." http://www.birchwoodcasey.com/sport_index.asp?categoryID=4&subcat=12 , pp. 1-2, internet accessed Jan. 16, 2006.
Birchwood Casey, "World of Targets®" http://www.birchwoodcasey.com/sport/target_index.asp?categoryID=4&subcat=13 , pp. 1-4, internet accessed Jan. 16, 2006.
Boyt Harness Company, Product Catalog, http://www.boytharness.com/catalog/index.php?cPath=22, 2 pages [Internet accessed on Jul. 21, 2008].
Brass Cleaning Kits, http://www.berrysmfg.com/81.php, 1 page [Internet accessed Apr. 24, 2007].
Brownells Inc., Brownells Magna-Tip Screwdriver, Brownells Catalog No. 54 for 2001-2002, 2001, p. 151.
Brownells Inc., Brownells Magna-Tip Super-Sets, Brownells Catalog No. 54 for 2001-2002, 2001, p. 153.
Brownells Inc., Catalog No. 41 1988-1989 3 pages.
Brownells Inc., Catalog No. 47 1994-1995 2 pages.
Brownells Inc., Catalog No. 57. For 2004-2005. 2 pages.
Brownells Inc., Sight Base Cutters, Faxed Dec. 17, 2003, 1 page.
B-Square , Pro Gunsmith Screwdriver Set, B-Square Mounts Tools Accessories Product Catalog. p. 23, date unknown.
Cabela's "Master Catalog Fall 2003: Late-Season Edition" Cover page and p. 416. 2 pages.
Cabela's Hunting Fishing and Outdoor Gear Master Catalog, Fall 2002, Edition II, Minimizer Rifle Rest, Item No. SC-22-4332, p. 492.
Cabela's, "BenchBuddy® Gun Rest," http://www.cabelas.com/cabelas/en/templates/links/link.jsp?id=0005819221954a&type=product&cmCat=, © 1996-2008, 2 pages [Internet accessed on Aug. 6, 2008].
Cabela's, "Elite Rifle Rest," http://www.cabelas.com/cabelas/en/templates/links/link.jsp?id=0005817227855a&type=product&cmCat=, © 1996-2008, 2 pages [Internet accessed on Aug. 6, 2008].
Cabela's, "Hyskore® Dangerous Game™ Machine Rest," http://www.cabelas.com/cabelas/en/templates/links/link.jsp?id=0044091228566a&type=product&cmCat=, © 1996-2008, 2 pages [Internet accessed on Aug. 6, 2008].
Cabela's, "Hyskore® Ultimate Sighting Rest," http://www.cabelas.com/cabelas/en/templates/links/link.jsp?id=0024152226083a&type=product&cmCat=, © 1996-2008, 2 pages [Internet accessed on Aug. 6, 2008].
Cabela's, "Nitro Shoulder Shield Rest," http://www.cabelas.com/cabelas/en/templates/links/link.jsp?id=0040862228231a&type=product&cmCat=, © 1996-2008, 2 pages [Internet accessed on Aug. 6, 2008].
Cabela's, "Premier Rifle Rest," http://www.cabelas.com/cabelas/en/templates/links/link.jsp?id=0020904227856a&type=product&cmCat=.., © 1996-2008, 2 pages [Internet accessed on Aug. 6, 2008].
Cabela's, "Secure Bench Rest," http://www.cabelas.com/cabelas/en/templates/links/link.jsp;jsessionid=4F0LP0OW2HMRLLAQBBISCOF.., © 1996-2008, 2 pages [Internet accessed on Aug. 6, 2008].
Cabela's, "Sharp Shooter Auto Magnum Rifle Rest," http://www.cabelas.com/cabelas/en/templates/links/link.jsp?id=0054107229088a&type=product&cmCat=, © 1996-2008, 2 pages [Internet accessed on Aug. 6, 2008].
Cabela's, "Sharp Shooter Rifle Rest," http://www.cabelas.com/cabelas/en/templates/links/link.jsp?id=0005816222738a&type=product&cmCat=, © 1996-2008, 2 pages [Internet accessed on Aug. 6, 2008].
Cabela's, "Shooting Benches & Portable Rifle Shooting Bench Rest," http://www.cabelas.com/ssubcat-1/cat20793.shtml, 3 pages [Internet accessed Jul. 18, 2008].
Cabela's, "Sure Shot Shooting Vise/Rest," http://www.cabelas.com/cabelas/en/templates/product/standard-item.jsp?id=00348272277 . . . , © 1996-2008, 2 pages [Internet accessed on Jul. 15, 2008].
Cabela's, "HySkore Sighting System and Cleaning Vise," the date on which the HySkore Sighting System and Cleaning Vise was first on sale is not known, but is believed to be circa Jan. 2005. However, a prototype of this product may have been shown to buyers at Cabela's circa Aug. 2004, 1 page.
Caldwell Insta-View™ 4" Targets.
Caldwell Shooting Supplies, 2006 Catalog, pp. 18, 5, 12, 14 and 15.
Caldwell Shooting Supplies, Targets & Target Accessories, InstraView™ Targets, 1 page.
Caldwells Insta-View 4" Targets, 1 page. [product photo].
Californiavarmintcallers.com—Forum, http://californiavarmintcallers.com/community/modules/newbb/viewtopic.php?topic_id=10&forum=9&PHPSESSID=074ed8c7 . . . , pp. 1-4, accessed Jan. 16, 2006.
Canadian Camo, "Gun Rest," http://media5.magma.ca/www.canadiancamo.com/catalog/product_info.php?products_id= . . . , 2 pages [Internet accessed on Feb. 13, 2006].
Carmichael, J., "Reloading for Accuracy," Lyman Reloading Handbook, 46th Edition, pp. 68-77.
Champion Targets, "Next Generation Paper Targets," http://www.championtarget.com/products/targets/next_generation_targets.aspx , pp. 1-3, [Internet accessed Jan. 16, 2006].
Champion Traps & Target, 2005 Product Catalog , 12 pages.
Chastain, R., "Load 'em Up!" About.com: Hunting/ Shooting, http://hunting.about.com/od/reloadinginfo/a/aaloademup_2htm , 6 pages [Internet accessed on Aug. 31, 2007].
Cork Industries, Inc., "Double Bumping Coating Applications," Cork Tech TalkNews, Feb. 1997, 2 pages.
CTK Precision, "P3 Ultimate Shooting Rest," http://www.ctkprecision.com/index.asp?PageAction=VIEWPROD&ProdOID=2, 3 pages [Internet accessed on Jul. 18, 2008].
CTK Precision, All Products, http://www.ctkprecision.com/index.asp?PageAction=VIEWCATS&Cate.., 3 pages [Internet accessed on Jul. 22, 2008].
CV-500, 3 pages [product photos].
Device manufactured by Shooter's Ridge, a division of ATK, and available at least by late 2005, 1 page.
Dillon Precision CV-500 Cartridge Case Vibratory Cleaner, 6 pages. [product photos].
E. Arthur Brown Company, "A Shooting Rest that Really Works..," http://www.eabco.com/TargetShooting01.html, © 2007-2008, 1 page [Internet accessed Jul. 18, 2008].

(56) References Cited

OTHER PUBLICATIONS

Edgewood Shooting Bags Catalog, http://www.edgebag.com/catalog.php, 7 pages [Internet accessed on Feb. 14, 2006].
Ellett Brothers, Rests & Gun Vises, pp. 621-622, date unknown.
Final Office Action; U.S. Appl. No. 10/865,595; Mailed on Apr. 3, 2007, 10 pages.
Final Office Action; U.S. Appl. No. 11/206,430; Mailed on Oct. 29, 2007, 13 pages.
Final Office Action; U.S. Appl. No. 11/206,430; Mailed on Nov. 24, 2008, 12 pages.
Final Office Action; U.S. Appl. No. 11/206,430; Mailed on Apr. 1, 2010, 14 pages.
Final Office Action; U.S. Appl. No. 11/271,100; Mailed on Sep. 22, 2008, 8 pages.
Final Office Action; U.S. Appl. No. 11/339,863; Mailed on Mar. 10, 2009, 6 pages.
Final Office Office Action; U.S. Appl. No. 11/431,956; Mailed on Nov. 27, 2009, 13 pages.
Final Office Action; U.S. Appl. No. 11/505,784; Mailed on Dec. 19, 2008. 10 pages.
Final Office Action; U.S. Appl. No. 11/507,683; Mailed on Apr. 6, 2010, 7 pages.
Final Office Action; U.S. Appl. No. 11/607,550; Mailed on Nov. 27, 2009, 14 pages.
Final Office Action; U.S. Appl. No. 11/679,100; Mailed on Aug. 3, 2009, 9 pages.
Final Office Action; U.S. Appl. No. 11/679,136; Mailed on Apr. 10, 2009, 22 pages.
Final Office Action; U.S. Appl. No. 11/679,832; Mailed on Jun. 8, 2010, 12 pages.
Final Office Action; U.S. Appl. No. 11/801,341; Mailed on Sep. 30, 2009, 6 pages.
Final Office Action; U.S. Appl. No. 11/844,980; Mailed on May 25, 2010, 6 pages.
Final Office Action; U.S. Appl. No. 11/853,763; Mailed on Jul. 13, 2009, 7 pages.
Final Office Action; U.S. Appl. No. 12/476,041; Mailed on Jul. 20, 2010, 7 pages.
Grafix Plastics, http://grafixplastic.com/plastic_film_g.asp?gclid=CK-5-_7gnY4CFRVNhgodjFhfSQ , 29 pages [Internet accessed on Aug. 30, 2007].
Harris, J. et al., "The Art and Science of Annealing," http://www.6mmbr.com/annealing.html, © 2005, 13 pages [Internet accessed on Aug. 13, 2007].
Hyskore, "Rest—Dangerous Game Machine Rest," Hyskore Rest, Professional firearm rests, http://www.hyskore.com/rests.htm, 2 pages [Internet accessed Jul. 21, 2008].
Hyskore: Professional Shooting Accessories. "Dangerous Game Machine Rest," Accessed Feb. 22, 2006 www.hyskore.com, 10 pages.
Hyskore: Professional Shooting Accessories. "Hydraulic Trigger Release." Accessed Feb. 22, 2006. www.hyskore.com 7 pages.
International Search Report and Written Opinion; International Patent Application No. PCT/US07/76440; Filed: Aug. 21, 2007; Applicant: Battenfeld Technologies, Inc.; Mailed on Sep. 30, 2008.
International Search Report and Written Opinion; International Patent Application No. PCT/US07/76587; Filed: Aug. 22, 2007; Applicant: Battenfeld Technologies, Inc.; Mailed on Jul. 30. 2008.
International Search Report and Written Opinion; International Patent Application No. PCT/US07/83674; Filed: Nov. 5, 2007; Applicant: Battenfeld Technologies, Inc.; Mailed on Jun. 11, 2008.
Joe's, "Shooter's Ridge Steady Point Shooting Rest," http://www.joessport.com/product/index.jsp?productID=3155005&cp=726872&parentpag.., Item No. 3155005, 1 page [Internet accessed Jul. 17, 2008].
Lahti Company Brochure, "Rock Solid Hold," Rifle Evaluator, http://www.lathicompany.com/Forms/EvaluatorBrochure2.jpg, 2 pages [Internet accessed Jan. 16, 2006].
Lahti Company Brochure, "Rifle Evaluator: No Pain, No Fear, No Flinching, No Body Movement," www.lahticompany.com, 2 pages, undated.
Lee Precision, Inc.. "Load-All," 1 page.
Lee Precision, Inc., "The World's Fastest Handloading Press . . . Lee Progressive 1000," 1985 Catalog, pp. 1-15.
Lohman Sight Vise, 4 pages product photographs, the date on which the Lohman Site Vise was first on sale is not known, but is believed to be circa 2004.
Lyman Hornady Case Tumbler, 2 pages [product photos].
Lyman Turbo 600 Tumbler, 3 pages [product photos].
Lyman Turbo Pro 1200 Tumber, 2 pages [product photos].
Lyman, "A History of Lyman Metallic Reloading," Reloading Handbook, 46th Edition, pp. 10-31.
Lyman, "Introduction to Reloading," Reloading Handbook, 46th Edition, pp. 170-203.
MacksPW.com, "Desert Mountain Bench Master Rifle Rest," http://www.macksqw.com/Item--i-DESBM1, © 2004-2008, 1 page [Internet accessed Jul. 22, 2008].
Midway USA, Chapman 27-Piece Deluxe Screwdriver Set, Master Catalog and Reference Guide #2, 2004, p. 440.
Midway USA, Pachmayr Professional Screwdriver Set, Master Catalog and Reference Guide #2, 2004, p. 448.
Midway USA, Wheeler Engineering Space-Saver Gunsmithing Screwdriver Set, Master Catalog and Reference Guide #2, 2004, p. 453.
Midway USA. "Tipton Range Box with Ultimate Rifle, Handgun Cleaning Kit (No Solvents)," http://www.midwayusa.com/rewriteaproduct/135086, The date on which the Tipton Range Box was first on sale is not known, but is believed to be circa 2004, 2 pages.
MidwayUSA, "ADG Rifle Shooting Rest," http://www.midwayusa.com/eproductpage.exe/showproduct?saleitemid=992071&t=11082005, 2005, 3 pages [Internet accessed on Aug. 6, 2008].
MidwayUSA, "Caldwell Full Length Fire Control Shooting Rest," http://www.midwayusa.com/eproductpage.exe/showproduct?saleitemid=683866&t=11082005, 2005, 3 pages [Internet accessed on Aug. 6, 2008].
MidwayUSA, "Caldwell Lead Sled DFT Rifle Shooting Rest," http://www.midwayusa.com/eproductpage.exe/showproduct?saleitemid=149023&t=11082005, 2005, 6 pages [Internet accessed on Aug. 6, 2008].
MidwayUSA, "Caldwell Lead Sled Rifle Shooting Rest," http://www.midwayusa.com/eproductpage.exe/showproduct?saleitemid=152664&t=11082005, 2005, 8 pages [Internet accessed on Aug. 6, 2008].
MidwayUSA, "Caldwell Steady Rest NXT Rifle Shooting Rest," http://www.midwayusa.com/eproductpage.exe/showproduct?saleitemid=8386518a=11082005, 2005, 4 pages [Internet accessed on Aug. 6, 2008].
MidwayUSA, "Caldwell Zero-Max Rifle Shooting Rest," http://www.midwayusa.com/eproductpage.exe/showproduct?saleitemid=726222&t=11082005, 2005, 3 pages [Internet accessed on Aug. 6, 2008].
MidwayUSA, "CTK Precision P3 Ultimate Shooting Rest," http://www.midwayusa.com/eproductpage.exe/showproduct?saleitemid=114699&t=11082005, 2005, 2 pages [Internet accessed on Aug. 6, 2008].
MidwayUSA, "Hyskore® dangerous Game Rifle Shooting Rest," http://www.midwayusa.com/eproductpage.exe/showproduct?saleitemid=729197&t=11082005, 2005, 3 pages [Internet accessed on Aug. 6, 2008].
MidwayUSA, "Hyskore® Precision Gas Dampened Recoil Reducing Rifle Shooting Rest," http://www.midwayusa.com/eproductpage.exe/showproduct?saleitemid=8388488.t=11082005, 2005, 4 pages [Internet accessed on Aug. 6, 2008].
MidwayUSA, "Hyskore® Swivel Varmint Rifle Shooting Rest," http://www.midwayusa.com/eproductpage.exe/showproduct?saleitemid=587606&t=11082005, 2005, 3 pages [Internet accessed on Aug. 6, 2008].
MidwayUSA, "Shooters Ridge Steady Point Rifle Shooting Rest and Vise," http://www.midwayusa.com/eproductpage.exe/

(56) References Cited

OTHER PUBLICATIONS showproduct?saleitemid=341095&t=11082005, 2005, 4 pages [Internet accessed on Aug. 6, 2008].
MidwayUSA, "Shooters Ridge Steady Point Rifle Shooting Rest," http://www.midwayusa.com/eproductpage.exe/showproduct?saleitemid=826745&t=11082005, 2005, 5 pages [Internet accessed on Aug. 6, 2008].
MidwayUSA, "Shooting Supplies—Shop Everything for Your Firearm at MidwayUSA," http://www.midwayusa.com/browse/BrowseProducts.aspx?categoryStrin . . . , 15 pages [Internet accessed on Jul. 21, 2008].
MidwayUSA, "Stoney Point Bench Anchor Rifle Shooting Rest," http://www.midwayusa.com/eproductpage.exe/showproduct?saleitemid=347174&t=11082005, 2005, 2 pages [Internet accessed on Aug. 6, 2008].
Milek, B., "Handloading for Hunting" New Products from RCBS, Lee, Accurate Arms, Peterson's Hunting, Mar. 1985, p. 21.
Millett, "BenchMaster Shooting Rests," 1 page, Undated.
MTM Case-Gard, "Gun Maintenance Centers," http://www.mtmcase-gard.com/products/shooting/gunm.html, the date on which the MTM Gun Maintenance Center was first on sale is not known, but is believed to be circa 2004, 2 pages. [Internet accessed Oct. 11, 2006].
MTM Case-Gard, "MTM Shoulder-Gard Rifle Rest," Cover Photo for Rest, p. 2, date unknown.
MTM Case-Gard, "Rifle rest and pistol shoot rest, " http://www/mtmcase-gard.com/products/shooting/shoo.html, the date on which the MTM Site-In-Clean was first on sale is not known, but is believed to be circa 2004, 3 pages. [Internet accessed on Oct. 11, 2006].
Non-Final Office Action; U.S. Appl. No. 10/865,595; Mailed on Jun. 7, 2006. 8 pages.
Non-Final Office Action; U.S. Appl. No. 11/206,430; Mailed on Jun. 23, 2009, 13 pages.
Non-Final Office Action; U.S. Appl. No. 11/206,430; Mailed on May 14, 2008, 10 pages.
Non-Final Office Action; U.S. Appl. No. 11/206,430; Mailed on May 21, 2007, 12 pages.
Non-Final Office Action; U.S. Appl. No. 11/271,100; Mailed on Mar. 26, 2008, 9 pages.
Non-Final Office Action; U.S. Appl. No. 11/311,530; Mailed on Feb. 13, 2007, 10 pages.
Non-Final Office Action; U.S. Appl. No. 11/339,863; Mailed on Sep. 23, 2008, 7 pages.
Non-Final Office Action; U.S. Appl. No. 11/418,407; Mailed on Feb. 24, 2009, 9 pages.
Non-Final Office Action; U.S. Appl. No. 11/431,956; Mailed on Mar. 2, 2009, 16 pages.
Non-Final Office Action; U.S. Appl. No. 11/505,784; Mailed on Dec. 26, 2007, 14 pages.
Non-Final Office Action; U.S. Appl. No. 11/505,784; Mailed on Oct. 27, 2009, 8 pages.
Non-Final Office Action; U.S. Appl. No. 11/507,683; Mailed on Sep. 18, 2008, 8 pages.
Non-Final Office Action; U.S. Appl. No. 11/607,550; Mailed on Mar. 2, 2009, 11 pages.
Non-Final Office Action; U.S. Appl. No. 11/607,550; Mailed on Jun. 17, 2010, 12 pages.
Non-Final Office Action; U.S. Appl. No. 11/679,100; Mailed on Oct. 16, 2008, 11 pages.
Non-Final Office Action; U.S. Appl. No. 11/679,100; Mailed on May 28, 2010, 9 pages.
Non-Final Office Action; U.S. Appl. No. 11/679,136; Mailed on Aug. 18, 2008, 6 pages.
Non-Final Office Action; U.S. Appl. No. 11/679,136; Mailed on Aug. 28, 2008, 8 pages.
Non-Final Office Action; U.S. Appl. No. 11/679,169; Mailed on Apr. 28, 2009, 11 pages.
Non-Final Office Action; U.S. Appl. No. 11/679,832; Mailed on Aug. 28, 2009, 9 pages.
Non-Final Office Action; U.S. Appl. No. 11/739,077; Mailed on Oct. 8, 2009, 7 pages.
Non-Final Office Action; U.S. Appl. No. 11/740,908; Mailed on Jan. 29, 2010, 8 pages.
Non-Final Office Action; U.S. Appl. No. 11/746,551; Mailed on Apr. 14, 2010, 8 pages.
Non-Final Office Action; U.S. Appl. No. 11/801,341; Mailed on Jan. 13, 2009, 7 pages.
Non-Final Office Action; U.S. Appl. No. 11/844,980; Mailed on Aug. 21, 2008, 8 pages.
Non-Final Office Action; U.S. Appl. No. 11/846,408; Mailed on Aug. 18, 2008, 8 pages.
Non-Final Office Action; U.S. Appl. No. 11/853,745; Mailed on Jun. 19, 2009, 11 pages.
Non-Final Office Action; U.S. Appl. No. 11/853,763; Mailed on Dec. 22, 2008, 6 pages.
Non-Final Office Action; U.S. Appl. No. 12/117,668; Mailed on Aug. 13, 2009, 15 pages.
Non-Final Office Action; U.S. Appl. No. 12/177,032; Mailed on Feb. 23, 2010, 6 pages.
Non-Final Office Action; U.S. Appl. No. 12/209,113; Mailed on Sep. 23, 2009, 6 pages.
Non-Final Office Action; U.S. Appl. No. 12/276,229; Mailed on Aug. 30, 2010, 8 pages.
Non-Final Office Action; U.S. Appl. No. 12/476,041; Mailed on Nov. 18, 2009, 6 pages.
Non-Final Office Action; U.S. Appl. No. 12/037,336; Mailed on Sep. 15, 2010, 33 pages.
Non-Final Office Action; U.S. Appl. No. 12/172,848, Mailed on Nov. 22, 2010, 32 pages.
Non-Final Office Action; U.S. Appl. No. 11/206,430; Mailed on Oct. 14, 2010, 18 pages.
Precision Shooting, Inc., Bald Eagle Front Rest, The Accurate Rifle, vol. 6, Issue No. 4, May 2003, p. 47.
Protektor Model, "The Original Leather Rifle and Pistol Rest," http://www.protektormodel.com/, 12 pages [Internet accessed on Feb. 14, 2006].
RCBS Automatic Primer Tool, pp. 68-71, undated.
RCBS, "Reloading Equipment," http://www.rcbs.com/default.asp?menu=1&s1=4&s2=3&s3=25, 1 page [Internet accessed Apr. 24, 2007].
Shooters Ridge, "Deluxe Rifle Rest," http://www.shootersridge.com, 1 page [Internet accessed Jul. 21, 2008].
Shooters Ridge, "Shooting Rest with Gun Vise," http://www.shootersridge.com, 1 page [Internet accessed Jul. 17, 2008].
Sinclair International, Sinclair Shooting Rests, Products for the Precision Shooter, 2002, Issue No. 2002-B pp. 76-78.
Sweeney, P., "Gunsmithing: Measure Headspace," Peterson's Rifleshooter, http://www.rifleshootermag.com/gunsmithing/headspace_0612/ , 4 pages [Internet accessed Dec. 11, 2004].
Tenex Precision Co., "Recoil A-Rest-R," 4 pages, date unknown [product photos].
The Blue Press, "Dillon Case Preparation Equipment," http://dillonprecision.com/template/p.cfm?maj=16&min=0&dyn=1&, Apr. 2007, 2 pages [Internet accessed Apr. 24, 2007].

* cited by examiner

STOWABLE SHOOTING TARGET ASSEMBLIES

TECHNICAL FIELD

The present disclosure is directed generally to shooting target assemblies and, more particularly, to stowable shooting target assemblies.

BACKGROUND

Many marksmen, including game hunters, competitive and non-competitive sportsmen, military personnel, law enforcement officers, as well as ranchers needing to protect livestock from predators, use firearms or bows and arrows. At some point in their training, most firearm operators and hunting archers use firearm targets to improve and practice their marksmanship skills. Target shooting may help marksmen measure and track their shooting accuracy. For example, the distance between the intended impact point and the actual impact point can be measured and recorded to monitor improvement in target shooting accuracy. Accordingly, targets and target assemblies are important tools in teaching, practicing, and improving marksman-related skills.

BRIEF DESCRIPTION OF THE DRAWINGS

In the drawings, identical reference numbers identify similar elements. Many of the details, dimensions, angles and other features shown in the Figures are merely illustrative of particular embodiments of the disclosure. Accordingly, other embodiments can add other details, dimensions, angles and features without departing from the spirit or scope of the present invention. In addition, those of ordinary skill in the art will appreciate that further embodiments of the invention can be practiced without several of the details described below.

DETAILED DESCRIPTION

1. Overview

Figure 1A:
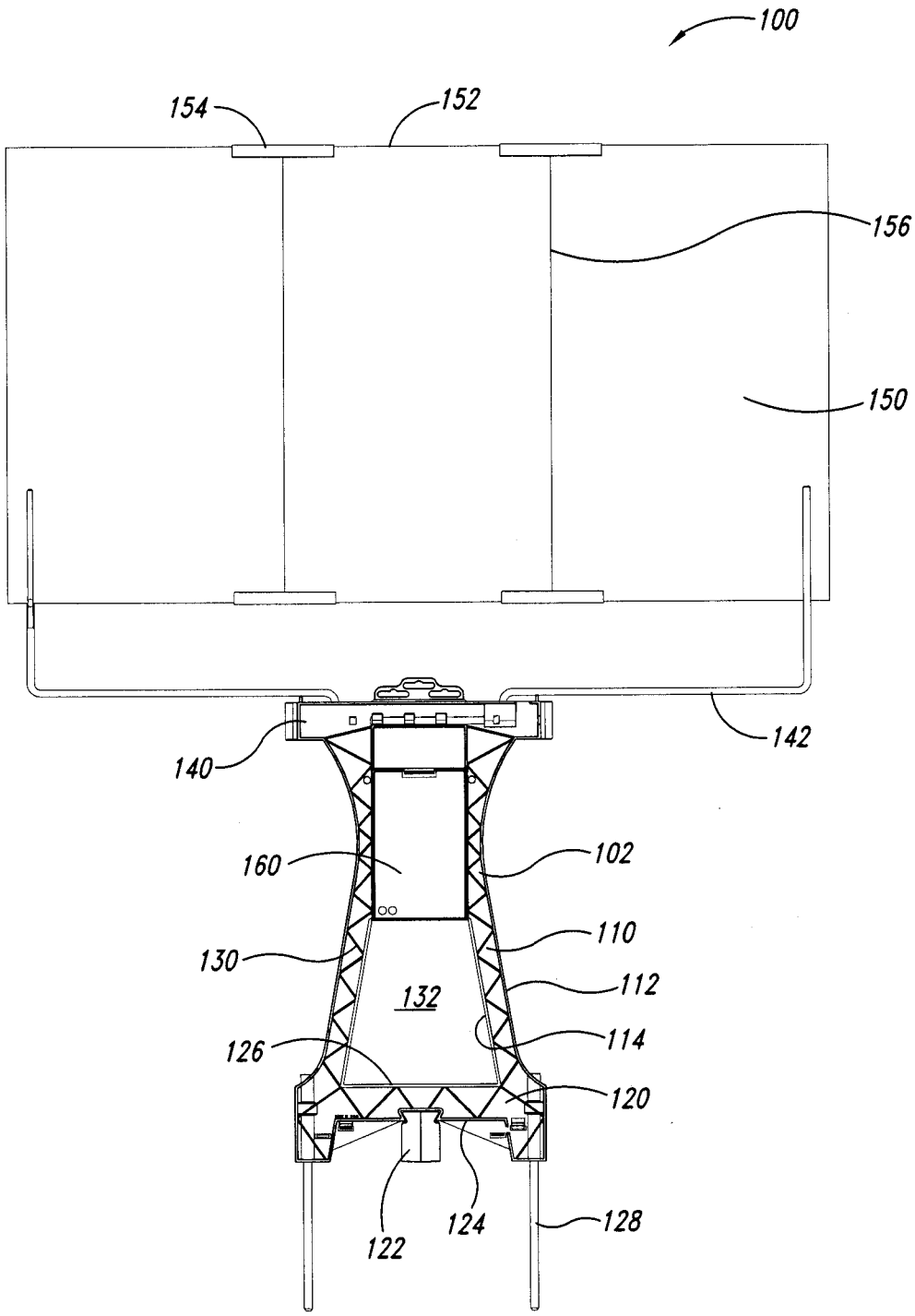
FIG. 1A is a front view of a shooting target assembly in accordance with an embodiment of the disclosure.

The present disclosure describes various embodiments of shooting target assemblies and associated systems and methods of use and manufacture. One aspect of the disclosure is directed to shooting target assemblies configurable in an assembled arrangement and a stowed arrangement. Another aspect of the disclosure is directed to shooting target assemblies having a stabilizer for improving target stability during operation.

In one embodiment, a shooting target assembly is arrangeable in an assembled configuration and a stowed configuration. The assembly can include a target stand frame, a stabilizer portion, a plurality of arms, and a plurality of stakes. The target stand frame can have a front side and a back side and an interior surface and an exterior surface. The stabilizer portion and arms can be removably coupled to the target stand frame.

In another embodiment, a shooting target assembly includes a backer, a plurality of arms, and a target stand frame. The backer can have a first side and a second side facing opposite from the first side. The target stand frame can have a front side and a back side. The target stand frame can include an arm support portion, a central portion, and a base portion having an upper surface and a lower surface. The base portion can include a plurality of stakes extending from the lower surface. The shooting target assembly can be arranged in an assembled configuration and in a stowed configuration. When the shooting target assembly is arranged in the assembled configuration, the arms can be removably coupled to the arm support portion and extend in a direction away from the target stand frame and the backer can be removably coupled to the arms. When the shooting target assembly is arranged in the stowed configuration, the arms can be removably coupled to the target stand frame and extend along at least a portion of the length of the center portion.

Another embodiment is directed to shooting target assemblies having a backer, a target stand frame, a stabilizing aperture sized to accept a foot, a plurality of stakes, and a plurality of arms. The backer can include a first side and a second side facing opposite from the first side. The target stand frame can have an interior surface, an exterior surface, a front side, and a back side. The stabilizing aperture can be bounded at least in part by the interior surface. The arms can be removably coupled to the target stand frame. When the shooting target assembly is in an assembled configuration, the arms can extend in a direction away from the target stand frame and the backer can be removably coupled to the arms.

Specific details of several embodiments of the disclosure are described below with reference to shooting target assemblies. Several details describing well-known structures or processes often associated with targets, target stands, and the manufacturing and use of target stands are not set forth in the following description for purposes of brevity and clarity. Also, several other embodiments of the disclosure may have different configurations, components, or procedures than those described in this section. A person of ordinary skill in the art, therefore, will accordingly understand that the disclosure may include other embodiments with additional features and characteristics, or the disclosure may include other embodiments without several of the features and characteristics shown and described below with reference to FIGS. 1A-4C.

Where the context permits, singular or plural terms may also include the plural or singular term, respectively. Moreover, unless the word "or" is expressly limited to mean only a single item exclusive from other items in reference to a list of at least two items, then the use of "or" in such a list is to be interpreted as including (a) any single item in the list, (b) all of the items in the list, or (c) any combination of the items in the list. Additionally, the term "comprising" is used throughout to mean including at least the recited feature(s) such that any greater number of the same features and/or other types of features and components are not precluded.

2. Embodiments

Figure 1B:
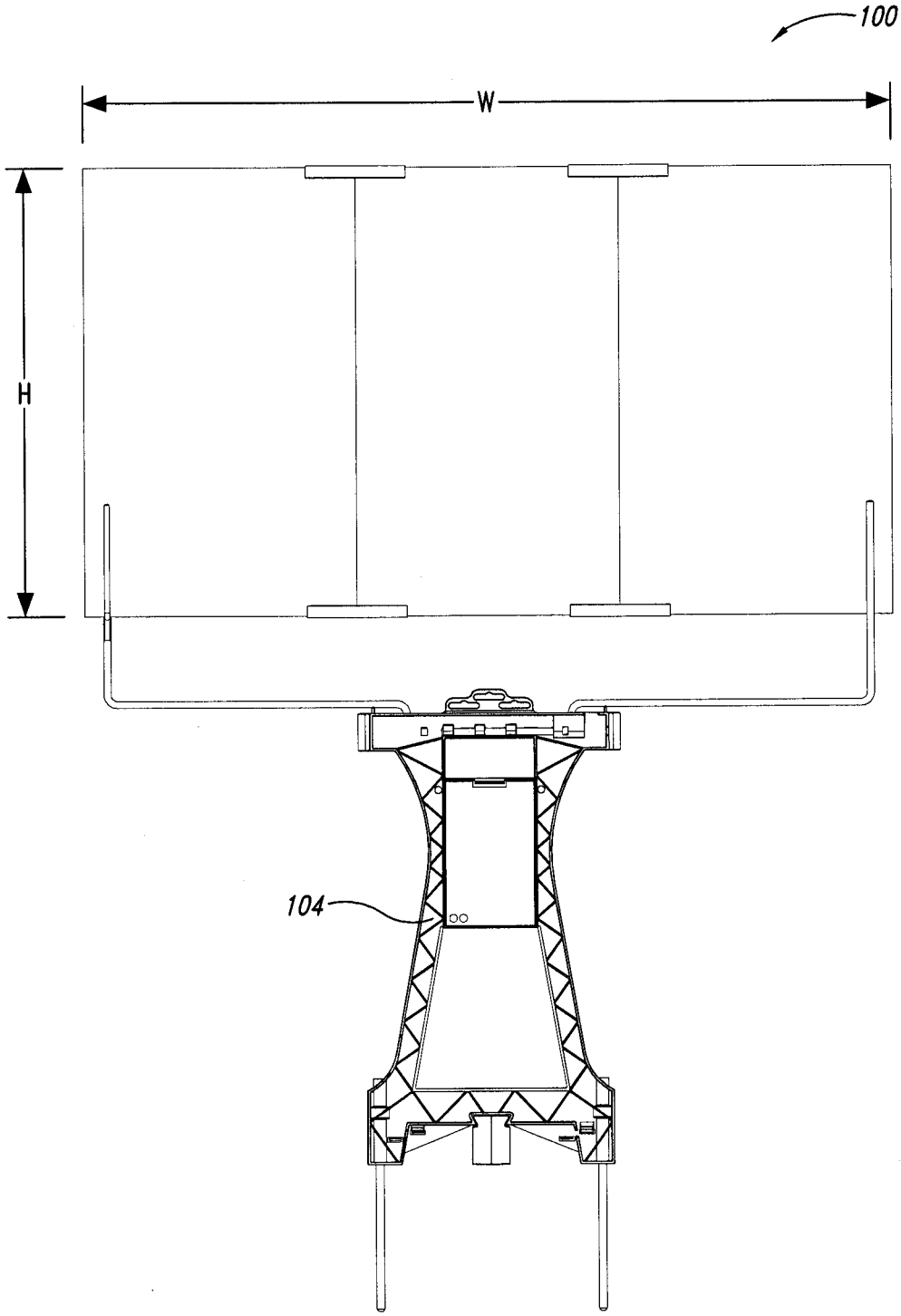
FIG. 1B is rear view of the shooting target assembly of FIG. 1A.
Figure 1C:
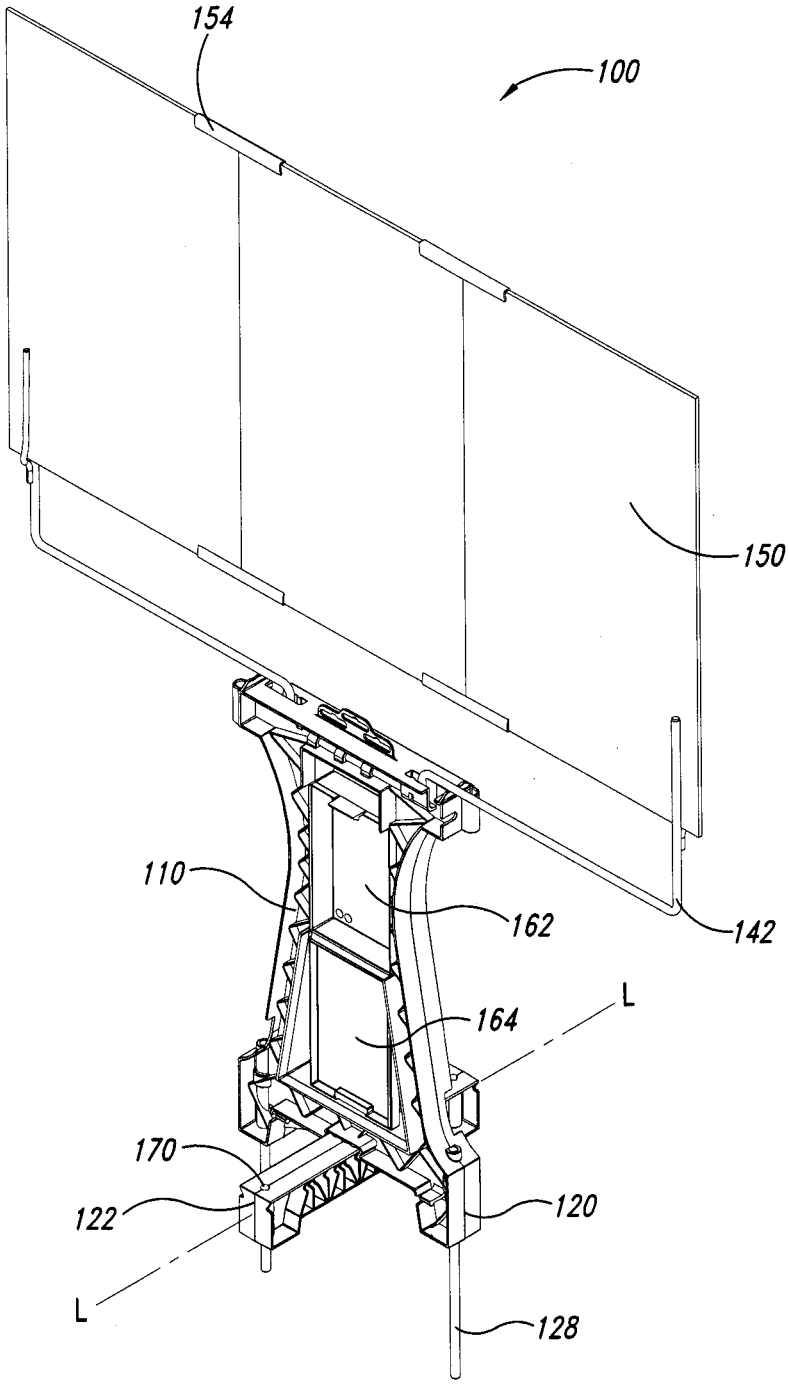
FIG. 1C is a front isometric view of the shooting target assembly of FIG. 1A.

FIG. 1A is a front view of a shooting target assembly 100 in accordance with an embodiment of the disclosure. FIG. 1B is a rear view of the shooting target assembly 100. FIG. 1C is a front isometric view of the shooting target assembly 100. Referring to FIGS. 1A-1C together, the shooting target assembly 100 has a front side 102 and a back side 104 opposite the front side 102. The assembly includes a target stand frame 110 and a backer 150. The frame 110 has an exterior surface 112 and an interior surface 114. The frame 110 can be made of molded plastic, metal, wood, other materials, or a combination of materials. In one embodiment, the frame 110 is made primarily of weather-resistant molded plastic. The frame 110 can include a base portion 120, a central portion 130 adjacent to the base portion 120, and an arm support portion 140 adjacent to the central portion 130.

The base portion 120 includes a lower surface 124 and an upper surface 126. The upper surface 126 is on the interior surface 114 of the frame 110 while the lower surface 124 is on the exterior surface 112 of the frame 110. The base portion 120 can include a plurality of stakes 128. As illustrated, the stakes 128 can extend vertically downward from the lower surface 124. In some embodiments the stakes 128 are made of metal, while in other embodiments the stakes 128 may be plastic or another material.

The base portion 120 can further include a stabilizer 122. In some embodiments, the stabilizer 122 can be removably attached to the lower surface 124. In the illustrated embodiment, a portion of the stabilizer 122 slideably dovetails with the lower surface 124 such that the longitudinal axis "L" of the stabilizer 122 is orthogonal to the front side 102 of the assembly 100. In some embodiments, the stabilizer 122 can include one or more holes 170 that at least partially penetrate the depth of the stabilizer 122. The holes 170 may be through holes or blind holes.

In some embodiments, the central portion 130 can include a storage box 160. The storage box 160 can be integral to the frame 110 or can be removable from the frame 110. The storage box 160 can be bounded at least in part by the interior surface 104 of the frame 110. The storage box can include a storage cavity 162 and a storage cavity lid 164. The lid 164 can be permanently attached to the storage cavity 162 by hinges or other means, or may be removably attached to the cavity 162 by snaps, friction, clasps, latches, Velcro, straps, or other mechanisms. FIGS. 1A and 1B illustrate the lid 164 in a closed configuration, while FIG. 1C illustrates the lid 164 attached to the cavity 162 in an open configuration. In some embodiments, the storage cavity 162 can be sized to hold at least one of a target supply, gun supply, or range supply.

The central portion 130 can further include a stabilizing aperture 132. The stabilizing aperture 132 can be bounded at least in part by the interior surface 114 of the frame, the storage box 160, and/or the upper surface 126 of the base portion 120. In some embodiments, the stabilizing aperture can be sized to accept a foot.

The arm support portion 140 can include a plurality of arms 142 extending outward, upward, or otherwise away from the central portion 130. The arms 142 can be removeably attached to the arm support portion 140.

The target backer 150 can have a front side and a back side opposite the front side. The backer 150 can be made of plastic, corrugated cardboard, paperstock, or other materials. In some embodiments, the backer 150 is weather-durable and is resistant against moisture and rotting. The backer 150 has a width W and a height H. In some embodiments, the width W is at least 30 inches and the height H is at least 15 inches. This embodiment allows for two 15 inch targets to be displayed on the backer 150 side-by-side.

In some embodiments, the backer 150 can include scored lines 156. In the illustrated embodiment, the scored lines 156 run vertically along the target backer 150. In other embodiments the scored lines 156 may run horizontally along the backer 150, there may be a combination of vertical and horizontal scored lines 156, or there may be other arrangements of one or more scored lines 156. A plurality of splines 154 can be secured at intersections of the scored lines 156 and backer edges 152. As discussed in more detail below with reference to FIG. 2, the target backer 150 can be removably coupled to the arms 142.

Figure 2:
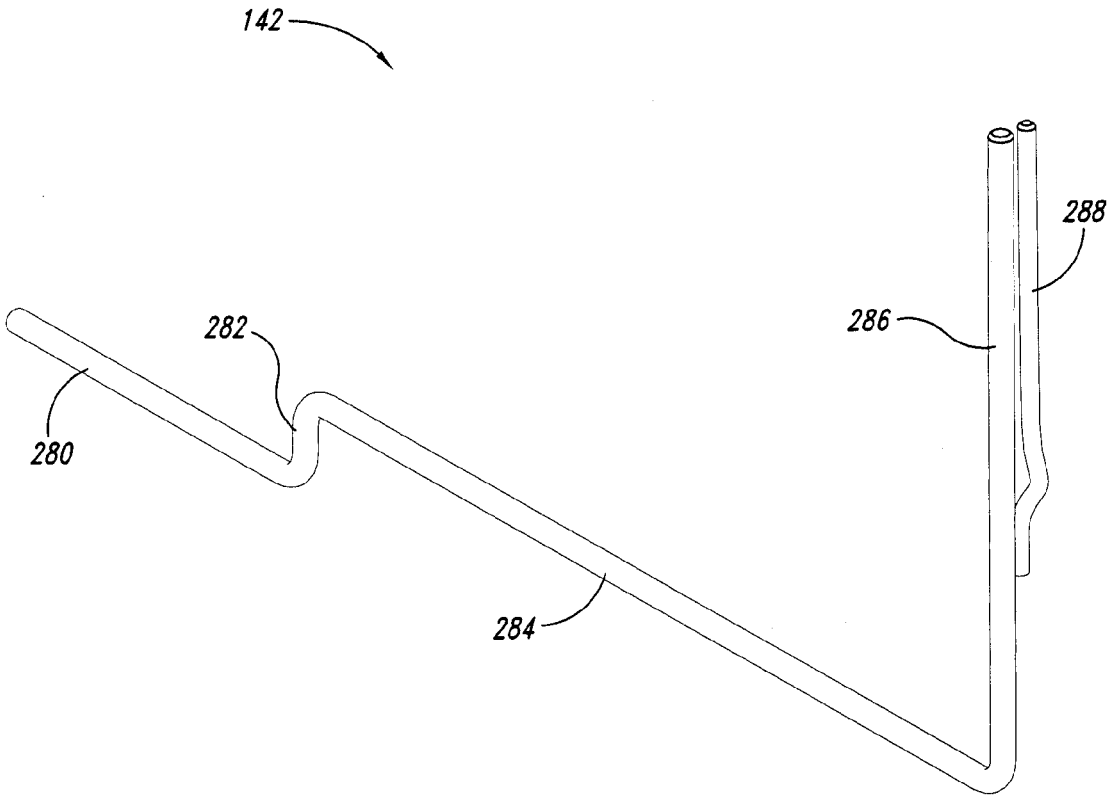
FIG. 2 is a front isometric view of an arm portion of a shooting target assembly in accordance with an embodiment of the disclosure.

FIG. 2 is a front isometric view of an arm portion 142 of a shooting target assembly 100 in accordance with an embodiment of the disclosure. The arm portion 142 includes a first portion 280, a second portion 282, a third portion 284, a fourth portion 286, and an arm clip 288. The second portion 282 attaches to the first 280 and third 284 portions at generally right angles. The fourth portion 286 attaches to the third portion 284 at a generally right angle. The clip 288 extends outward from the fourth portion 286 and extends for a length in a generally parallel path to the fourth portion 286. The fourth portion 286 and the clip 288 are spaced apart by approximately the thickness of the target backer 150. The fourth portion 286 and the clip 288 can sandwich a portion of the target backer 150. The arms 142 can be made of metal, molded plastic, wood, other materials, or a combination of materials.

Figure 3:
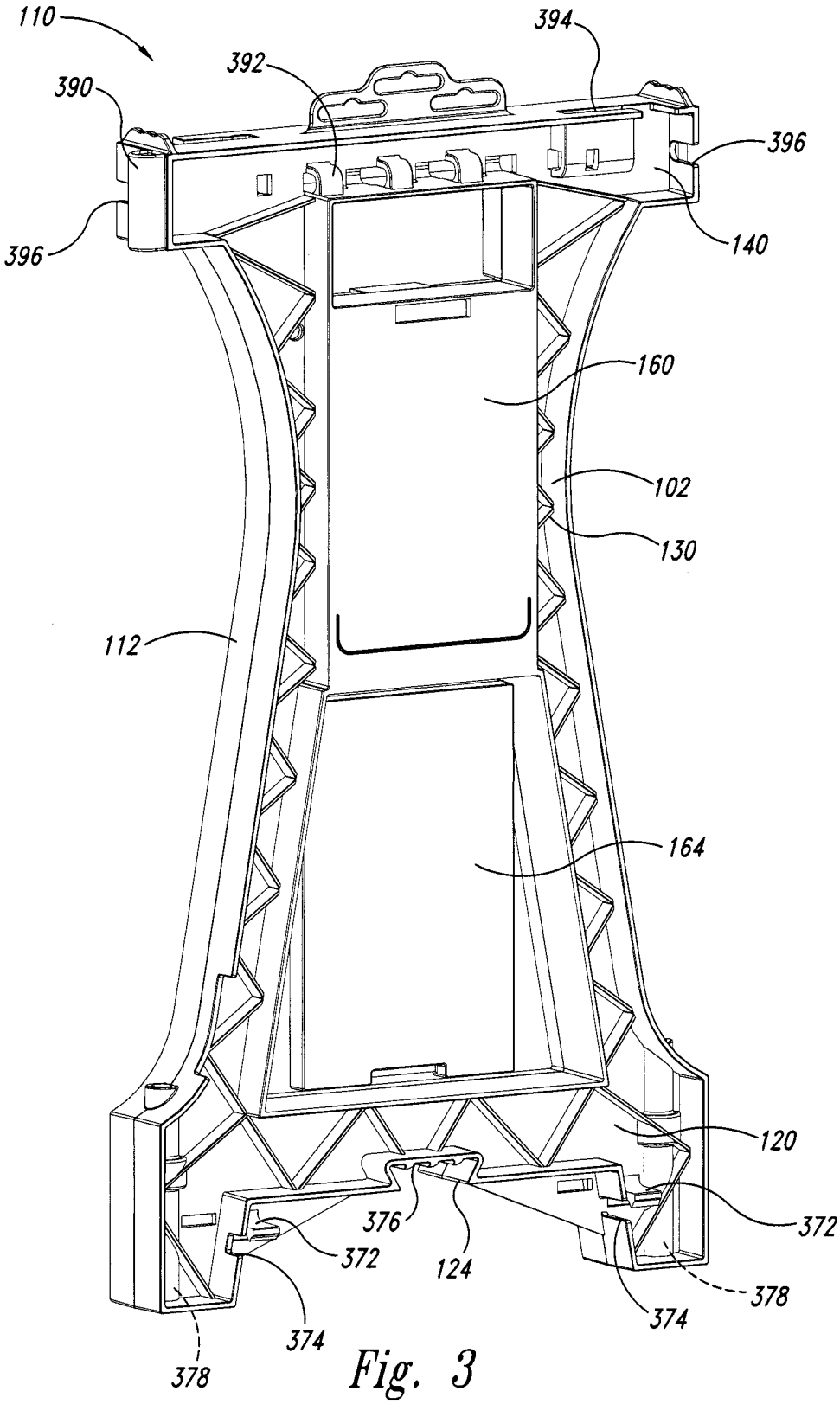
FIG. 3 is a front isometric view of a target stand frame of a shooting target assembly in accordance with an embodiment of the disclosure.

FIG. 3 is a front isometric view of a target stand frame 110 of a shooting target assembly 100 in accordance with an embodiment of the disclosure. As discussed above with reference to FIGS. 1A-1C, the frame 110 includes a base portion 120, a central portion 130, and an arm support portion 140. The base portion 120 can include stowing grasps 372 and stowing recesses 374 on the front side 102 of the frame 110. The base portion 120 can include stowing grasps 372 and stowing recesses 374 in corresponding positions on the back side 104 of the frame 110 (not shown). The stowing grasps 372 and stowing recesses 374 are sized to surround one or more portions of the arm 142 (not shown). The grasps 372 can be latches, locks, clasps, or other securing features. The base portion 120 can also include a recess 376 in the lower surface 124 of the base 120. The recess 376 in the lower surface 124 of the base 120 is sized to dovetail with the stabilizer 122 (not shown). The base portion 120 can further include a plurality of blind holes 378 embedded within the frame 110. The blind holes 378 open to the exterior surface 112 of the frame 110. Each blind hole 378 is sized to receive a stake 128 (not shown).

The arm portion 140 of the assembly frame 110 can include a stowing enclosure 390, one or more supporting enclosures 392, a supporting track 394, and a supporting recess 396 on the front side 102 of the frame 110. The arm support portion 140 can also include these features in corresponding positions on the back side 104 of the frame 110 (not shown). The stowing enclosure 390 can be a blind hole or a through hole. The supporting enclosures 392 can be through holes. The stowing enclosure 390, supporting enclosures 392, supporting track 394, and supporting recess 396 can be sized to surround a portion of an arm 142.

As shown in FIGS. 1A-1C, the target stand assembly 100 can be arranged in an assembled configuration which can be used as a support structure for a target. Referring to FIGS. 1A-3 together, in the assembled configuration, a stake 128 is positioned within each of the blind holes 378. The stakes 128 may be threaded or held in place within the blind holes 378 by friction, latching, clasping, or other mechanisms. In other embodiments, the stakes 128 are molded in the blind holes 378. The stakes 128 extend vertically downward from the lower surface 124 of the base portion 120. The stabilizer 122 dovetails the recess 376 in the lower surface 124 of the base 120. As described above, the longitudinal axis L of the stabilizer 122 is orthogonal to the front side 102 of the frame 110. A user can push the stakes 128 into the ground plane (not shown) to secure the vertical orientation of the assembly 100. The user can further secure the assembly 100 by inserting his foot into the stabilizing aperture 132 and pressing downward on the interior surface 114 of the frame 110. This action presses the assembly 100 further into the ground to increase stabilization. When the assembly 100 is pushed into the ground, a portion of the lower surface 124 of the base 120 as well as the stabilizer 122 are in contact with the ground plane. The stabilizer 122 is thus a cross-brace that prevents the assembly 100 from forward or backward movement caused by wind or force from ammunition or arrows that have struck the target.

In the assembled configuration, the arms 142 are secured to the arm support portion 140 of the frame 110 and positioned to support the backer 150. Specifically, the first portion 280 of the arm 142 is enclosed by one or more supporting enclosures 392 on the front side 102 of the frame 110. The second portion 282 of the arm 142 is positioned or threaded within the supporting track 394. The supporting track 394 maintains the second portion 282 in an upright orientation. The third portion 284 of the arm 142 extends outwardly from the frame 110. The fourth portion 286 of the arm 142 projects upward from the frame 110. A second arm 142 is positioned in the same manner through enclosures 392 and a track 394 on the back side 104 of the frame 110.

The backer 150 is buttressed by the arms 142. Specifically, the backer 150 is removably positioned between the fourth portion 286 of the arm 142 and the clip 288, as discussed above with reference to FIG. 2. The fourth portion 286 and the clip 288 sandwich the backer 150 to maintain the backer 150 in an upright and stable position. The splines 154 are positioned where the scored lines 156 meet the edges 152 on the backer 150. The splines 154 keep the target backer 150 rigid while in use. One or more targets (not shown) may be affixed to the backer 150 by the splines 154 or by other attachment mechanisms known in the art, such as adhesive, clips, or tacks. In some embodiments, two targets may be positioned side-by-side on the backer 150.

Figure 4A:
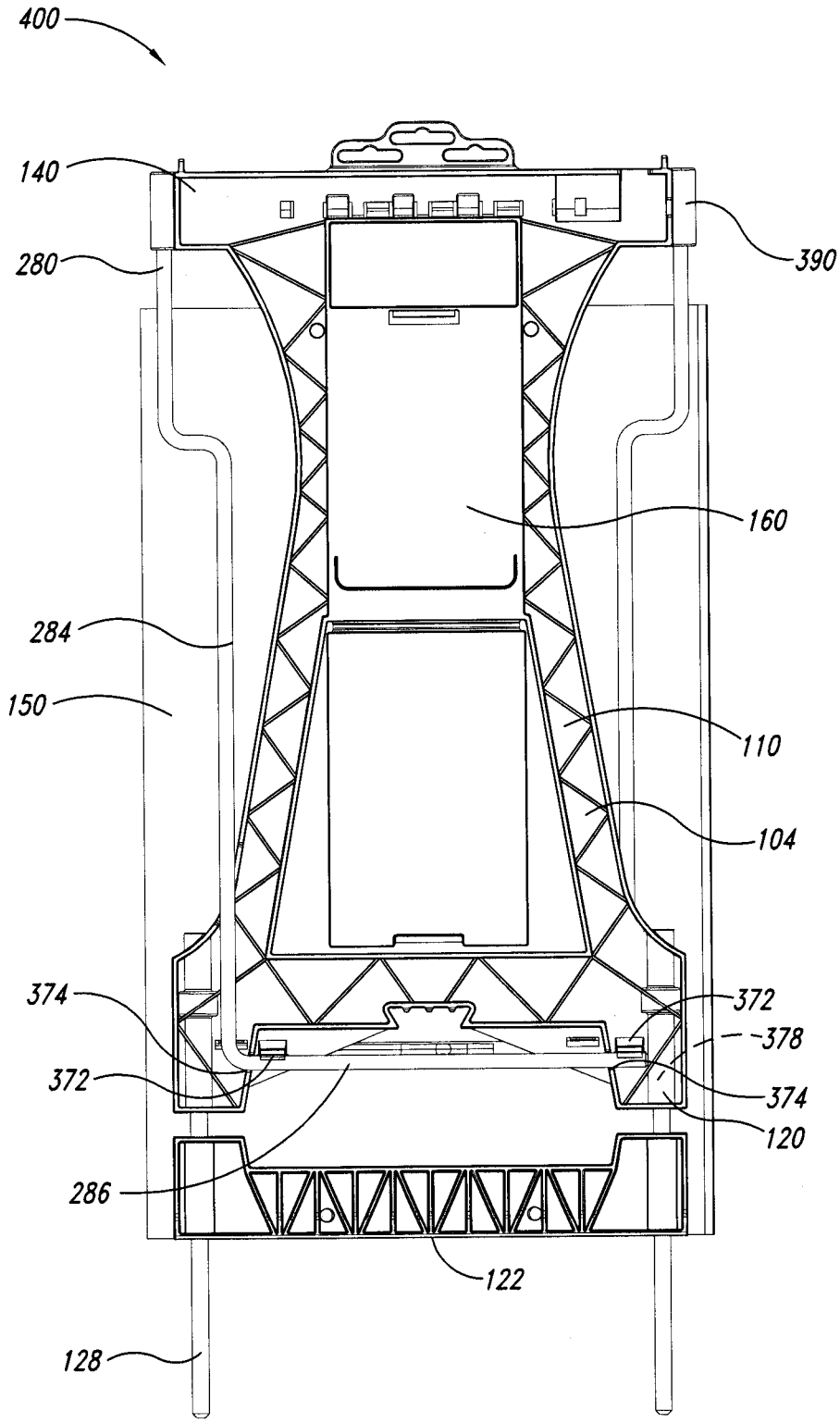
FIG. 4A is a rear view of a shooting target assembly in accordance with an embodiment of the disclosure.
Figure 4B:
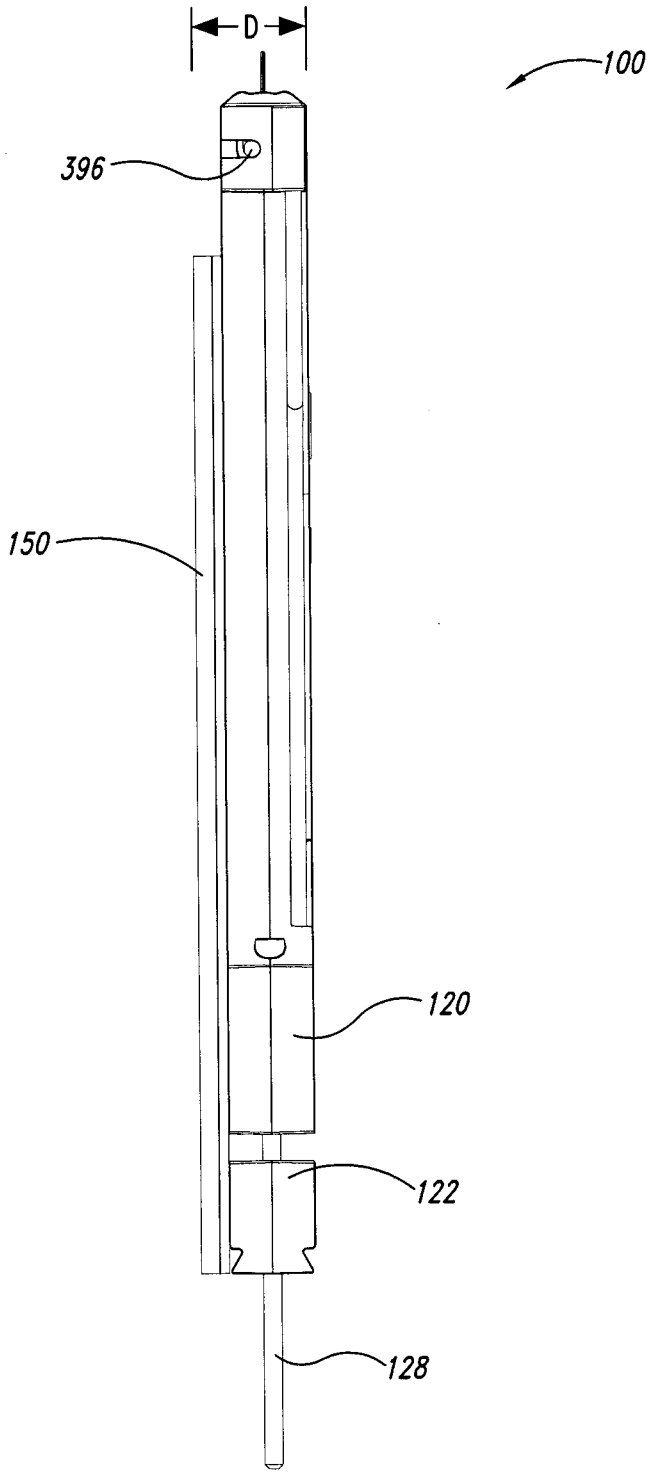
FIG. 4B is a side view of the shooting target assembly of FIG. 4A.
Figure 4C:
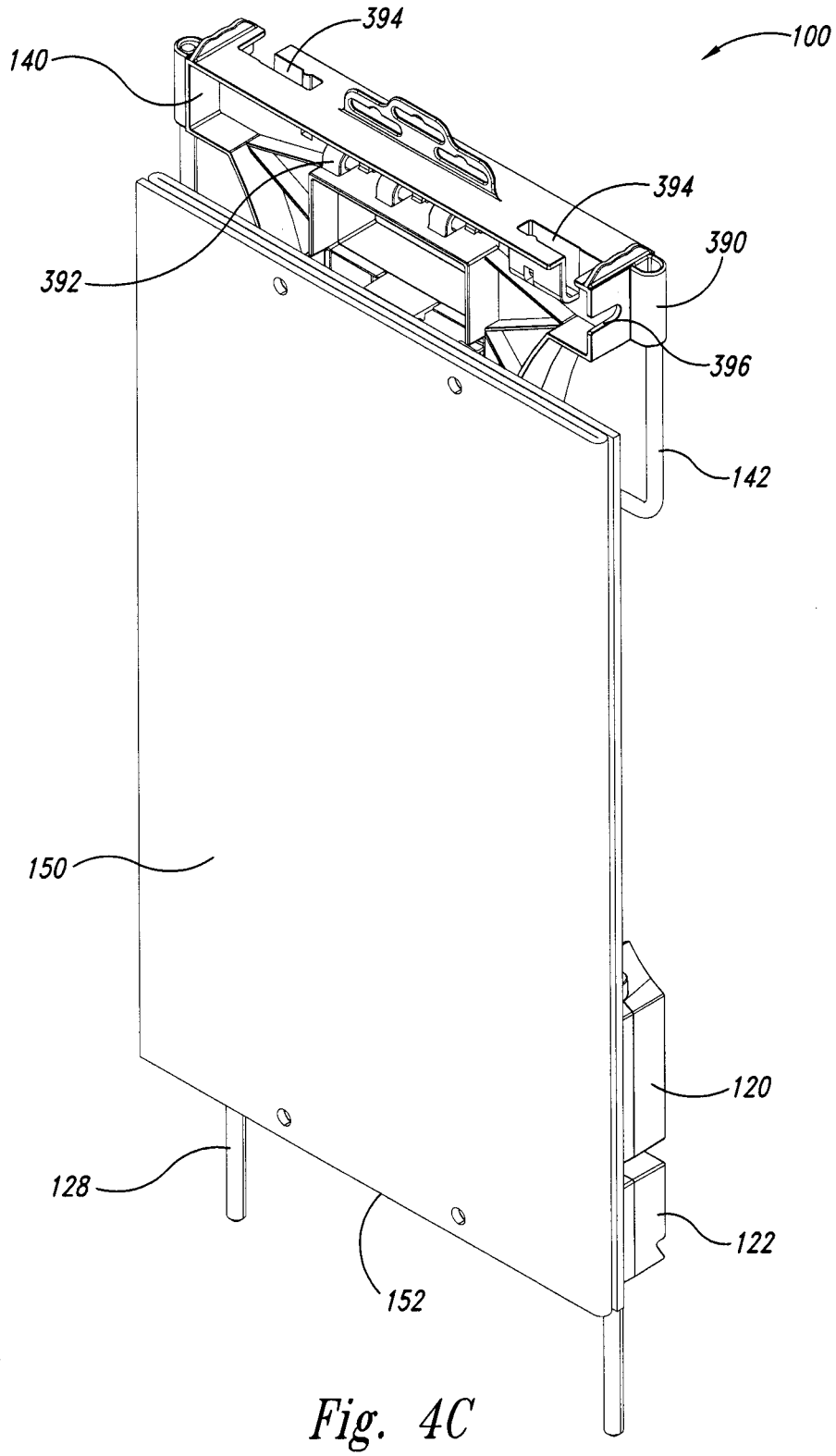
FIG. 4C is a front isometric view of the shooting target assembly of FIG. 4A.

FIG. 4A is a rear view of a shooting target assembly 400 in accordance with an embodiment of the disclosure. FIG. 4B is a side view of the shooting target assembly 400. FIG. 4C is a front isometric view of the shooting target assembly 400. As illustrated in FIGS. 4A-4C, the target stand assembly 400 can be arranged in a stowed configuration. The assembly 400 transforms from an assembled configuration to a stowed configuration by folding the backer 150 and stowing the arms 142 and stabilizer 122. Referring to FIGS. 4A-4C together, in the stowed configuration, the target stand assembly 400 is arranged for flatter, space-efficient stowability.

In the stowed configuration, the backer 150 is detached from the arms 142. The splines 154 (not shown) are removed from the edges 152 of the backer 150. The backer 150 is folded along the scored lines 156 and may be secured to the frame 110 by hooks, clasps, snaps, straps, other mechanisms, or may not be attached at all. When the backer 150 is folded along the scored lines 156, it takes up less square footage than in the assembled configuration.

When stowed, the arms 142 extend along a length of the central portion 130 of the target stand frame 110 and are removably secured to the arm support portion 140 and the base portion 120. Specifically, at least a length of the first portion 280 of the arm 142 is received within the stowing enclosure 390 on the back side 104 of the frame 110. The first portion 280 and the third portion 284 run along the length of the frame 110. The fourth portion 286 of the arm 142 extends through the stowing recesses 374 and is releasably secured in place by the stowing grasps 372. One arm 142 may be stowed on each of the front 102 and back 104 sides of the frame 110.

In the stowed configuration, a stake 128 again extends from each of the blind holes 378. The stabilizer 122 is stowed by threading a stake 128 through each of the holes 170 on the stabilizer 122. The stabilizer 122 can then slide up the stakes 128 so that the stabilizer 122 is adjacent to the base portion 120 of the frame 110. In this configuration, the stabilizer 122 is no longer orthogonal to the front 102 of the frame 110, but is instead coplanar to the frame 110.

Conversion from an assembled configuration to a stowed configuration is simple and greatly reduces the space required by the assembly 100. For example, in one embodiment, the stowed assembly has dimensions of 10.5 inches wide, 24 inches long, and 2 inches deep. In the stowed configuration, the assembly 100 can be stored essentially flatly and can be more easily transported and merchandised.

From the foregoing, it will be appreciated that specific embodiments of the invention have been described herein for purposes of illustration, but that various modifications may be made without deviating from the spirit and scope of the various embodiments of the invention. Further, while various advantages associated with certain embodiments of the invention have been described above in the context of those embodiments, other embodiments may also exhibit such advantages, and not all embodiments need necessarily exhibit such advantages to fall within the scope of the invention. Accordingly, the invention is not limited, except as by the appended claims.

We claim:

1. A shooting target assembly arrangeable in an assembled configuration and a stowed configuration, the assembly comprising:

a target stand frame having a front side and a back side, the target stand frame comprising an arm support portion, a central portion adjacent to the arm support portion, and a base portion adjacent to the central portion, wherein the base portion has an upper surface, a lower surface, and a plurality of stakes extending from the lower surface; and a plurality of arms removably coupled to the arm support portion, wherein:

when the shooting target assembly is arranged in the assembled configuration, the arms have a first connection with the target stand frame and extend in a direction away from the target stand frame; and when the shooting target assembly is arranged in the stowed configuration, the arms have a second connection with the target stand frame different than the first connection and extend along a length of the central portion.

2. A shooting target assembly arrangeable in an assembled configuration and a stowed configuration, the assembly comprising:

a target stand frame having a front side and a back side, the target stand frame comprising an arm support portion, a central portion adjacent to the arm support portion, and a base portion adjacent to the central portion, wherein the base portion has an upper surface, a lower surface, and a plurality of stakes extending from the lower surface; and a plurality of arms removably coupled to the arm support portion, wherein:

when the shooting target assembly is arranged in the assembled configuration, the arms extend in a direction away from the target stand frame; and when the shooting target assembly is arranged in the stowed configuration, the arms extend along a length of the central portion; and the arm support portion comprises at least one enclosure on each of the front side and the back side and at least one track on each of the front side and the back side; and when the shooting target assembly is in the assembled configuration, each arm is threaded through an enclosure and is adjacent to a track.

3. The shooting target assembly of claim 1 wherein: the arm support portion comprises at least one stowed arm enclosure; the base portion comprises at least one securing feature; and when the shooting target assembly is in the stowed configuration, a portion of each arm occupies the stowed arm enclosure and a portion of each arm is removably coupled to the target stand frame by at least one securing feature.

4. The shooting target assembly of claim 1 wherein the target stand frame further includes an interior surface and an exterior surface, and wherein the central portion includes a stabilizing aperture bounded and defined at least in part by the interior surface of the target stand frame and the upper surface of the base, the stabilizing aperture being sized for accepting a foot of a human.

5. The shooting target assembly of claim 1 wherein the target stand frame is made primarily of molded plastic.

6. The shooting target assembly of claim 1, further comprising a stabilizer removably coupled to the base portion.

7. The shooting target assembly of claim 1 wherein the target stand frame further comprises a storage cavity sized to hold at least one of a target supply, gun supply, or range supply.

8. The shooting target assembly of claim 1 further comprising:

a stabilizer having a longitudinal axis that is generally orthogonal to the front side of the target stand frame when the assembly is in the assembled configuration, and the stabilizer being removably connected to and coplanar to the target stand frame when the assembly is in the stowed configuration.

9. The shooting target assembly of claim 8 wherein: the base portion includes a recess sized and shaped to dovetail with the stabilizer.

10. The shooting target assembly of claim 8 wherein when the assembly is in the stowed configuration, the stakes are threaded through apertures in the stabilizer.

11. The shooting target assembly of claim 1, further comprising a backer, wherein when the shooting target assembly is in an assembled configuration, the arms extend away from the target stand frame and the backer is removably coupled to the arms,

12. The shooting target assembly of claim 1 wherein when the shooting target assembly is in a stowed configuration, a portion of each arm occupies a stowed arm enclosure, a portion of each arm is removably coupled to the target stand by a grasp, and a portion of each arm extends along a length of the target stand frame.

13. The shooting target assembly of claim 8 wherein the target stand frame has an interior surface that at least partially bounds a stabilizing aperture, and wherein the stabilizing aperture is sized to accept a foot of a human.

14. The shooting target assembly of claim 1, wherein the arms are made primarily of metal.

15. The shooting target assembly of claim 1, further comprising a backer having a width of at least 30 inches.

16. The shooting target assembly of claim 1 wherein the arms have respective first portions and respective second portions spaced from the first portions and, when the shooting target assembly is in the assembled configuration and the arms have the first connection with the target stand frame, the first portions of the arms are engaged with the target stand frame and the second portions are free of engagement with the target stand frame, and when the shooting target assembly is in the stowed configuration and the arms have the second connection with the target stand frame, the first portions of the arms and the second portions of the arms are engaged with the target stand frame.

17. The shooting target assembly of claim 16 wherein the first and second portions of the arms are opposite end portions of the arms.

18. The shooting target assembly of claim 16 wherein the target stand frame includes connection structure for connecting the arms to the target stand frame in the assembled position and, when the shooting target assembly is in the stowed configuration and the arms have the second connection with the target stand frame, the first portions of the arms are connected to the target stand frame in a different orientation with respect to the connection structure than when the shooting target assembly is in the assembled configuration and the arms have the first connection with the target stand frame.

19. A shooting target assembly arrangeable in an assembled configuration and a stowed configuration, the assembly comprising:

a target stand frame having a front side and a back side, and an interior surface and an exterior surface;

a plurality of arms removably coupled to the target stand frame;

a plurality of stakes coupled to and extending away from the target stand frame;

a stabilizer removably coupled to the target stand frame, wherein the stabilizer has a longitudinal axis that is generally orthogonal to the front side of the target stand frame when the assembly is in the assembled configuration and coplanar to the target stand frame when the assembly is in the stowed configuration; and a target backer having at least one scored line, wherein the target backer is foldable along the scored line; and a plurality of splines removably coupled to a periphery of the target backer.

20. The shooting target assembly of claim 19 wherein the target stand frame further comprises a storage cavity sized to hold at least one of a target supply, gun supply, or range supply,

21. The shooting target assembly of claim 19, wherein the interior surface of the target stand frame at least partially bounds and defines a stabilizing aperture sized to accept a foot of a human.

22. The shooting target assembly of claim 19 wherein the target stand frame is made primarily of plastic.

23. The shooting target assembly of claim 19 wherein the target backer has a width of at least 30 inches.

24. The shooting target assembly of claim 19 wherein when the shooting target assembly is in a stowed configuration, a portion of each arm occupies a stowed arm enclosure, a portion of each arm is removably coupled to the target stand by a grasp, and a portion of each arm extends along a length of the target stand frame.

25. The shooting target assembly of claim 19 wherein the exterior surface includes a recess in an end portion thereof, wherein the recess is sized and shaped to removably receive the stabilizer, and wherein a longitudinal axis of the stabilizer is generally orthogonal to a front side of the target stand frame when the stabilizer is removably positioned in the recess.

* * * * *